US008739853B2

(12) United States Patent
Judkins

(10) Patent No.: US 8,739,853 B2
(45) Date of Patent: Jun. 3, 2014

(54) CORDLESS BLIND AND OPERATOR DEVICE

(76) Inventor: Ren Judkins, Pittsburgh, PA (US)

( * ) Notice: Subject to any disclaimer, the term of this patent is extended or adjusted under 35 U.S.C. 154(b) by 1394 days.

(21) Appl. No.: 11/544,813

(22) Filed: Oct. 7, 2006

(65) Prior Publication Data

US 2007/0023151 A1 Feb. 1, 2007

Related U.S. Application Data

(63) Continuation-in-part of application No. 10/704,851, filed on Nov. 10, 2003, now Pat. No. 7,117,919, which is a continuation-in-part of application No. 09/815,403, filed on Mar. 22, 2001, now Pat. No. 6,644,372.

(51) Int. Cl.
*A47H 5/00* (2006.01)

(52) U.S. Cl.
USPC ..... 160/170; 160/171; 160/84.04

(58) Field of Classification Search
USPC ..... 160/170, 171, 178.1 R, 173 R
See application file for complete search history.

(56) References Cited

U.S. PATENT DOCUMENTS

| | | | | |
|---|---|---|---|---|
| 13,251 | A | | 7/1855 | Bixler |
| 322,732 | A | | 7/1885 | Lang |
| 1,951,659 | A | | 3/1934 | Kesner |
| 2,317,659 | A | | 4/1943 | Williams |
| 2,420,301 | A | | 5/1947 | Cusumano |
| 2,659,573 | A | | 11/1953 | Smith, Sr. |
| 3,249,148 | A | | 5/1966 | Zablodil et al. |
| 3,485,285 | A | | 12/1969 | Anderle |
| 3,487,875 | A | | 1/1970 | Shukat et al. |
| 4,623,012 | A | | 11/1986 | Rude et al. |
| 4,676,292 | A | | 6/1987 | Valle et al. |
| 4,909,298 | A | * | 3/1990 | Langhart et al. ..... 160/178.1 R |
| 5,070,927 | A | | 12/1991 | Chen |
| 5,105,867 | A | | 4/1992 | Coslett |
| 5,133,399 | A | | 7/1992 | Hiller et al. |
| 5,263,786 | A | | 11/1993 | Kageyama |
| 5,285,838 | A | | 2/1994 | Rapp et al. |
| 5,476,132 | A | | 12/1995 | Jacobson |
| 5,482,100 | A | | 1/1996 | Kuhar |
| 5,531,257 | A | | 7/1996 | Kuhar |
| 5,680,891 | A | | 10/1997 | Prince |
| 5,706,876 | A | | 1/1998 | Lysyj |
| 5,778,956 | A | | 7/1998 | Judkins |
| 5,799,715 | A | * | 9/1998 | Biro et al. ..... 160/170 |
| 5,813,447 | A | | 9/1998 | Lysyj |
| 5,906,232 | A | | 5/1999 | Bauer et al. |
| 5,915,866 | A | | 6/1999 | Furukawa |
| 5,960,846 | A | | 10/1999 | Lysyj |
| 5,997,204 | A | | 12/1999 | Ducrocq |
| 6,003,584 | A | | 12/1999 | Weinreich |
| 6,012,506 | A | | 1/2000 | Wang et al. |

(Continued)

*Primary Examiner* — Blair M. Johnson
(74) *Attorney, Agent, or Firm* — Buchanan Ingersoll & Rooney PC

(57) ABSTRACT

A cordless blind contains a lift mechanism, such as one or more spring motors, one or more cord collectors and a lock mechanism. An operator device such as a cord or wand is connected to the lift mechanism and is movable relative to the bottomrail. When the bottomrail is a selected distance from the headrail a portion of the cord or wand will move away from the bottomrail. The selected distance corresponds to the height of the bottomrail at which it is difficult for an operator to reach the bottomrail. The released cord or wand will enable the user to operate a lock mechanism in the bottomrail or move the bottomrail.

20 Claims, 19 Drawing Sheets

(56) References Cited

U.S. PATENT DOCUMENTS

| | | | | |
|---|---|---|---|---|
| 6,024,154 | A | 2/2000 | Wang et al. | |
| 6,029,734 | A | 2/2000 | Wang et al. | |
| 6,056,036 | A | 5/2000 | Todd et al. | |
| 6,079,471 | A | 6/2000 | Kuhar | |
| 6,135,189 | A | 10/2000 | Weinreich | |
| 6,644,372 | B2 | 11/2003 | Judkins | |
| 6,684,930 | B2 | 2/2004 | Palmer | |
| 6,889,741 | B1 | 5/2005 | Cheng et al. | |
| 6,918,424 | B2 | 7/2005 | Lin | |
| 2002/0088562 | A1 | 7/2002 | Palmer | |
| 2003/0024656 | A1* | 2/2003 | Ciuca | 160/170 |
| 2003/0196765 | A1 | 10/2003 | Ciuca et al. | |
| 2004/0177933 | A1 | 9/2004 | Hillman et al. | |
| 2007/0084567 | A1* | 4/2007 | Chen | 160/84.05 |
| 2008/0078511 | A1* | 4/2008 | McCarty et al. | 160/168.1 R |
| 2008/0083509 | A1* | 4/2008 | Hsu et al. | 160/84.05 |
| 2008/0202705 | A1* | 8/2008 | Cheng et al. | 160/170 |

* cited by examiner

FIG. 1
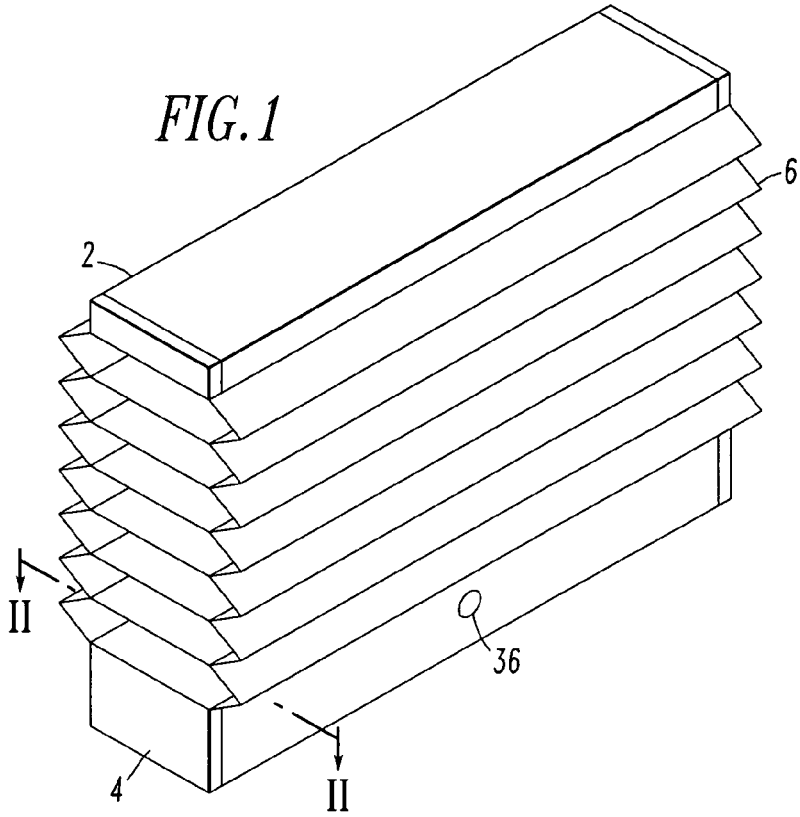
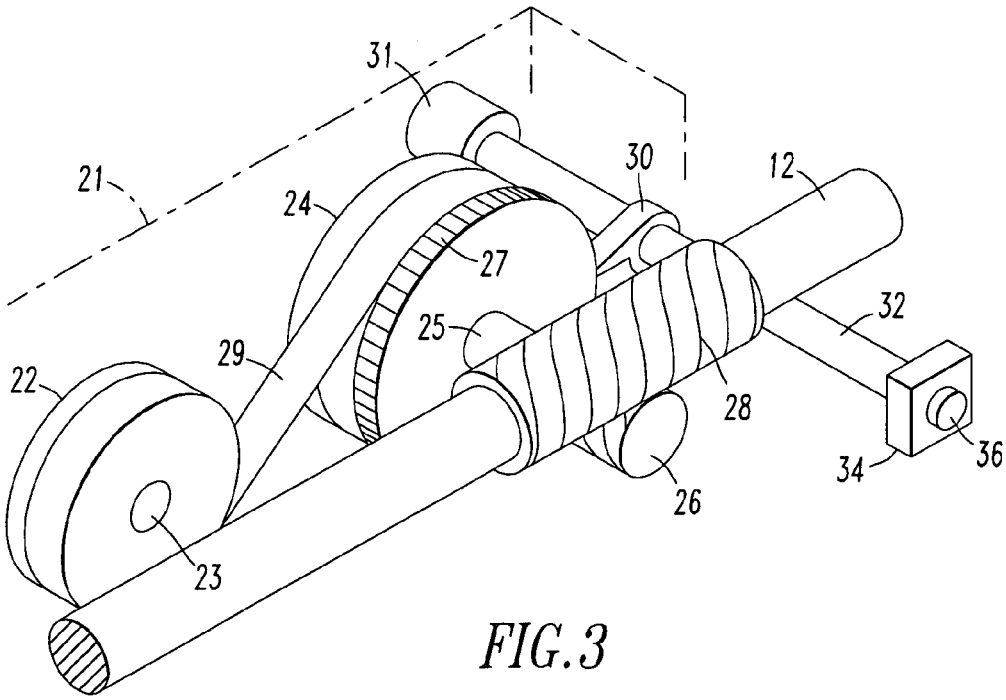
FIG. 3

12
212
211
210
148
146

CORDLESS BLIND AND OPERATOR DEVICE

CROSS REFERENCE TO RELATED APPLICATION

This application is a Continuation-in-part of U.S. patent application Ser. No. 10/704,851, file Nov. 10, 2003 now U.S. Pat. No. 7,117,919. U.S. patent application Ser. No. 10/704,851 was a Continuation-in-part of U.S. patent application Ser. No. 09/815,403, filed on Mar. 22, 2001, now U.S. Pat. No. 6,644,372.

FIELD OF INVENTION

The invention relates to a lock mechanism for raising and lowering cordless window blinds, such as pleated shades, roman shades, and venetian blinds.

BACKGROUND OF THE INVENTION

Venetian type blinds have a series of slats hung on ladders that extend from a headrail to a bottomrail. In most venetian blinds a pair of lift cords is provided each having one end attached to the bottomrail and then passing through elongated holes in the slats up to and through the headrail. When the lift cords are pulled downward the blind is raised and when the lift cords are released the blind is lowered. A cord lock is usually provided in the headrail through which the lift cords pass. The cord lock allows the user to maintain the blind in any desired position from fully raised to fully lowered. Pleated shades and roman shades are also raised and lowered by lift cords running from the bottom of the shade into a headrail. The cord lock system and other cord lift systems used in venetian blinds can also be used in pleated shades and roman shades.

Another type of lift system for window blinds utilizes a take-up tube for each lift cord. These tubes are contained on a common shaft within the headrail. Each lift cord is attached to one end of a tube. The tubes are rotated to wind or unwind the lift cord around tubes. This system is generally known as a tube lift system. Some tube lift systems are operated by a continuous loop cord that passes over one end of the axle and extends from the headrail.

In recent years the art has been concerned that cords, particularly looped cords, pose a strangulation threat to children who may become entangled in the cords. Consequently, there has been much interest in cordless blinds. These blinds rely on electric motors or spring motors to raise and lower the lift cord. One common cordless blind simply contains a motor connected to a tube collection system within the headrail. Another cordless blind relies upon a constant force spring motor attached to a spool or spools on which the lift cords are collected. This type of cordless blind is disclosed by Coslett in U.S. Pat. No. 5,105,867 and by Kuhar in U.S. Pat. Nos. 5,482,100; 5,531,257 and 6,079,471 and by Wang et al. in U.S. Pat. Nos. 6,012,506, 6,024,154 and 6,029,734.

Coslett discloses a sun shade having a series of blades connected together to form a serrated shape like a pleated shade. The upper blade is mounted within a hollow housing and the lower blade is secured to a plate member. A constant force spring plate is wound around a spring spool member and further engaged to an output spool, both of which are within a hollow handle secured to the hollow housing. A cord is connected to the output spool and passed from the handle through the housing and the blades and is connected to the plate member. Such a cording arrangement is similar to that of a lift cord in a pleated shade or venetian blind. The spring retains the blades in a folded closed position. When the shade is extended the spring exerts tension on the cord. Consequently, Coslett teaches the user to fix the plate member along one side of the window and to provide a hook to retain the hollow housing at the opposite side of the window when the shade is covering the window. Thus, Coslett's shade can be in only one of two positions, fully extended to cover the window or fully retracted. Furthermore, Coslett's blind is not suitable for installation in an orientation in which one rail is fixed at the top of the window frame as is done for most building windows. That is so because when the blind is fully retracted most people could not reach the handle to extend or close the blind without standing on a stool or ladder.

Kuhar discloses a cordless, balanced blind that contains at least one constant variable force spring motor in the headrail. The springs in these motors vary in thickness or in width along their length as they are wound around storage drums. A cord spool is coupled to one or more spring drums. The lift cords of the blind are wound about the spool. Thus, the spring winds or unwinds as the blind is raised or lowered. The difference in width or thickness of the spring compensates for the increasing weight of the blind on the cords as the window covering is raised and the decreasing weight as the blind is lowered. Kuhar teaches that much effort must be made to select and couple the spring motor to the cords so that the bottomrail is balanced at any and every position. Kuhar further teaches that several spring motors may be coupled together.

If the system is not in balance when the operator positions the bottomrail at a desired location, the bottomrail moves upward or downward to a location at which the system is balanced. Consequently, it is not possible to keep the bottomrail at the desired location without adjusting or replacing the spring motors. Several people in the industry have recognized that a solution to the problem is to provide a cord lock or brake that acts on the lift cords or spring motors. Wang et al. in U.S. Pat. No. 6,029,734 disclose a cordless blind with a locating unit provided in the bottomrail which prevents the lift cords from moving until the operator presses a button on the bottomrail. Another lock mechanism which engages the coil springs in a cordless blind is disclosed in U.S. Pat. No. 6,024,154. Both the springs and the lock mechanism are located in the bottomrail. This lock mechanism is also biased to a locked position. The bottomrail can be raised and lowered only while the lock button is being pressed to disengage the lock. Palmer in Published United States Patent Application 2002/0088562 discloses a one way brake which prohibits the bottomrail from moving toward the headrail, but permits the bottomrail to be moved away from the headrail by an operator. The brake must be released by pushing a button or lever in the bottomrail to raise the bottomrail. All of these cordless blinds require the operator to hold the lock button or lever to move or raise the bottomrail. If such a blind is installed in a tall window many people would be unable to reach a fully raised blind without climbing on a ladder or chair. Even if the blind were in a standard window, short people would not be able to fully raise the blind without using a ladder. Operators would also have difficulty fully raising such a blind if a couch or other furniture were in front of the window.

SUMMARY OF THE INVENTION

I provide a cordless blind containing one or more springs in the bottomrail or moving rail of the blind. Preferably the spring is a constant force spring motor of the type disclosed by Coslett and Kuhar. The spring motor is connected to at least one cord collector in a manner to maintain tension on the cord collector. The tension causes the lift cords to be collected on the cord collector when the cord collector and the lift cords are free to move, thereby moving the bottomrail toward the headrail. I further provide a lock mechanism attached to the cord collector or the lift cords. The lock mechanism has a locked position wherein the lift cords are restrained from being collected on the cord collector, or from being removed from the cord collector, or both. The lock mechanism also has an unlocked position that allows the cord collector and plurality of lift cords to move freely. The lock mechanism can be in either a locked position in which the bottomrail will not move in at least one direction, or in an unlocked position, which allows the bottomrail to move upward or downward freely. The lock mechanism is positioned in the bottomrail or moving rail and is designed so that the operator is not required to hold a button to keep the lock in an unlocked position.

A first present preferred embodiment of the lock mechanism has a rotary-cam mechanism similar to those used in ball-point pens. Pressing a button once changes the lock mechanism from a locked position to an unlocked position. Pressing the button again changes the lock from an unlocked position to a locked position.

A second present preferred embodiment of the lock mechanism has a pair of buttons that move a locking arm between a locked position and an unlocked position. The end of the arm has a tooth which engages a gear attached to the spring motor or cord collector when the lock is in a locked position.

A third present preferred embodiment of the lock mechanism is similar to the second but has a lever that is moved from side to side to engage or release the locking arm. In each of these embodiments one could substitute a sprocket for the locking arm. Pressing the button or lever would move the sprocket from the unlocked position to the locked position.

A fourth preferred embodiment of the lock mechanism utilizes a ratchet type lock similar to that used in roller shades. However, in this lock a movable lever, rather than pawl, engages the sprocket. The lever extends from the bottomrail. Moving the lever in one direction fully disengages the lever from the sprocket. Moving the lever in an opposite direction engages the sprocket.

A fifth embodiment of the lock mechanism has a locking arm activated by buttons or a lever that engages a ratchet that is attached to the spring motor or cord collector. The ratchet functions as a one way lock when engaged by the locking arm. In this condition the lift cords can move in only one direction allowing the shade to be raised or allowing the shade to be lowered. When the locking arm is disengaged, the bottomrail is free to move in either direction.

A cord or wand could be attached to the button or lever in any of these embodiments to permit operation of the lock mechanism when the bottomrail is beyond the reach of the operator. A clip or magnet can be provided to nest the cord or wand against the bottomrail when the blind is in a fully-lowered or partially-lowered position.

The embodiments that utilize a lever could also have a retractable operator cord. In this version, an operator cord is provided on a spool within the bottomrail. A motor or clutch mechanism is attached to the spool and allows the cord to play out of the bottomrail when the bottomrail is a selected distance from the headrail. An operator may then use the cord to further raise or lower the blind. When the bottomrail is a second related distance from the headrail, the operator cord is retracted into the bottomrail.

The cordless blind of the present invention is easy to operate. A user simply presses the button or lever, moves the bottomrail or moving rail to a desired position, and presses the button or lever again to lock the lock mechanism. Because the lift cords and cord collector are no longer free to move, the bottomrail stays in the desired position. When the bottomrail is beyond the reach of the user a cord or wand can be used to operate the lock mechanism. Consequently, the operator can place the bottomrail or moving rail at any desired location between a fully raised position and a fully lowered position.

This cordless blind could be a pleated shade, a cellular shade, a roman shade or a venetian blind. If the shade is a venetian blind I prefer to provide ladders in which the rails of the ladders are connected to form a continuous loop. Then the slats can be tilted with a conventional tilt mechanism in the headrail.

BRIEF DESCRIPTION OF THE FIGURES

FIG. 1 is a rear perspective view of a present preferred embodiment of my cordless blind.

FIG. 3 is an enlarged view of the spring motor in the embodiment shown in FIGS. 1 and 2.

DESCRIPTION OF THE PREFERRED EMBODIMENTS

Figure 2:
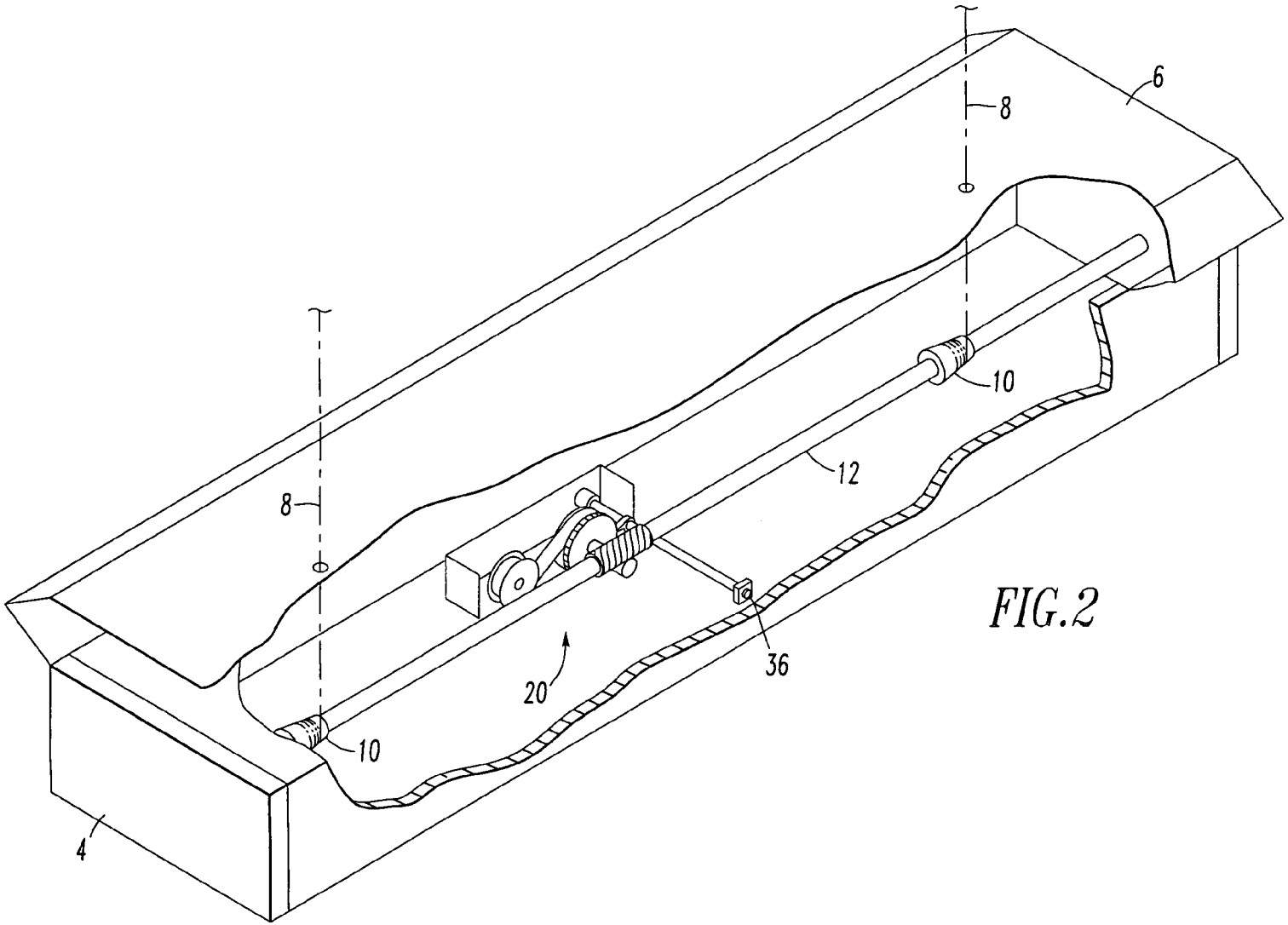
FIG. 2 is a sectional view taken along the line II-II of FIG. 1 wherein a portion of the front wall of the bottomrail has been cut away.

A present preferred embodiment of my cordless blind or shade shown in FIG. 1 is comprised of a headrail 2, a bottomrail 4 and a window covering material such as cellular material 6 connected between the headrail and the bottomrail. The window covering material could also be a single panel of pleated material, roman shade material or a set of slats carried on ladders, as in a venetian blind. The blind could be any width or length, and likely would be larger than the blind shown in FIG. 1. Lift cords 8 are fixed within the headrail, pass through the window covering material and into the bottomrail. Although only two lift cords 8 are shown in FIG. 2 it should be understood that the cordless blind could have more lift cords with the number of lift cords being related to the width of the blind. The lift cords 8 are collected on cones 10 within the bottomrail. The cones each have a central bore that enables them to be mounted on a common axle 12. The axle 12 is coupled to a spring motor 20 shown in detail in FIG. 3. If desired the cones could be omitted and the cords could be wrapped on the axle.

In a standard tube lift the lift cord is wound about a cylindrical tube or cylindrical axle. Consequently, each rotation of the axle will collect or release a length of cord equal to the circumference of the tube which can be calculated from the equation $L=\pi dn$ where d is the outside diameter of the tube plus the diameter of the cord and n is the number of revolutions. In blinds for standard residential and commercial windows the axle may rotate 40 or more times to fully raise or lower the blind. All window blinds that have lift cords will have at least two lift cords and each lift cord is wound on a separate tube. Although all tubes and cords are supposed to be the same diameter, one tube or cord often is larger than the diameter of another tube or cord with differences in diameters often being 0.005 inches and may be as much as 0.010 inches. Since the spool will rotate as many as eighty to over a hundred times to fully lower the blind, that means one lift cord will be lowered 0.4 inches more than the other lift cord. A difference of 0.25 inches is noticeable to a person looking at the blind or shade. Hence, if there is a difference in diameters in the cords or the axles the bottom of the shade will appear to be tilted. If the blind has more than two cords and the short cord is in the middle the bottomrail acts like a teeter-totter pivoting about the short middle cord and the whole blind oscillates as the blind is being raised or lowered.

In the lift system shown in FIG. 2 the total length of lift cord that will be released is determined by the equation:

$$L = \frac{\pi d_1 - d_2}{2}$$

Because a cone offers a series of different diameters a fabricator can position the cones on the axle so that the lift cords begin wrapping at different locations on the cones. Consequently, the fabricator can compensate for variations among cones and cords. The result is that every blind can be fabricated so that the bottom of the blind is level when the blind is fully lowered. The fabricator can adjust the position of the cord simply by rotating the cone relative to the axle.

Referring to FIGS. 2 and 3 the spring motor 20 has a bracket 21 on which a storage drum 22 and an output drum 24 are rotatably mounted in a spaced apart relationship. The storage drum is free to rotate about axle 23. When the output drum 24 rotates it turns axle 25 and attached gear 26. Output drum 24 has gear teeth or an attached gear 27 that engages pawl 30. When gear 26 turns, gear 28 on shaft 12 will also turn turning the shaft 12. A spring 29 is coupled between the storage drum 22 and the output drum 24. The spring provides a constant tension on the lift cords acting through the axles 23 and 12 and gears 26 and 28. Helical gears or crown gears can be used here. The spring 29 may be configured in one of several ways to provide the desired tension. The first configuration has a constant thickness throughout the length of the spring. One end of the spring is narrower than the opposite end of the spring with the width gradually increasing or decreasing form one end to the other end. The narrow end is attached to the center of the storage drum 22 and the wider end attached to the center of the output drum. The spring is wound from one drum to the other in an opposite coil orientation. As the spring 29 is transferred from the storage drum 22 to the output drum 24, the width of the spring between the two drums will decrease and the spring will be wound oppositely to its original coil shape. Another embodiment of the spring varies in thickness from one end to the other end but has a constant width. The thinner end is attached at the core of the storage drum. The thicker end is attached to the core of the output drum. As in the first configuration, the orientation of the spring as it is transferred from the storage drum to the output drum is reversed. A third possible configuration is for the spring to vary in both width and thickness. Also, a laminated coil spring could be used.

A control shaft 32 extends from hub 31 to a control box 34. The control shaft carries a pawl 30 having teeth that will mesh with gear teeth 27 on drum 24. Control shaft 32 may not rotate but can move transversely along its centerline. Consequently, when pawl 30 engages the teeth 27 on drum 24, the drum as well as the spring motor and the lift cords will not move. Button 36 controls movement of control shaft 32. In one configuration a rotary-cam mechanism is provided within hub 31 or control box 34. Pushing the button once will cause the pawl to move away from the teeth on drum 24. The pawl will stay in that unlocked position until the button is pressed again. The second push of the button moves shaft 32 returning the pawl 30 to the locked position in engagement with teeth 27 on drum 24. Rotary-cam mechanisms are well-known in the art and commonly used in ball-point pens. Examples of rotary-cam mechanisms used in ball-point pens are disclosed in U.S. Pat. Nos. 5,263,786; 5,915,866 and 5,997,204 whose teachings are incorporated herein by reference. Rather than providing a button and rotary-cam to activate the lock, a knob could be used as the lock activator. Turning the knob would move pawl 30 into and away from the teeth to drum 24.

In the embodiment shown in FIGS. 1 through 3 the lock mechanism is connected directly to the spring motor. As will be apparent from the discussion of other preferred embodiments, the lock mechanism could be connected to the cord collector or act directly on the cords.

Figure 4:
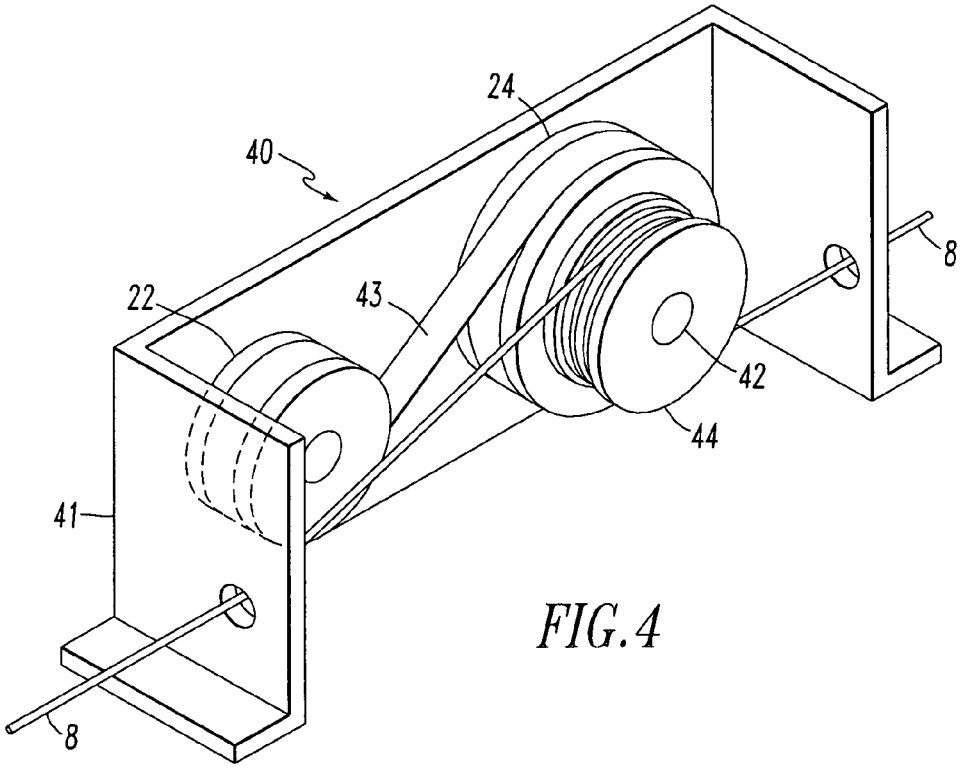
FIG. 4 is a perspective view similar to FIG. 3 of an alternative spring motor that can be used in the cordless blind of the present invention.

Several other configurations of spring motors can be used. The spring motor 40 of FIG. 4 has a storage drum 22 and a take up drum 24 carried on a bracket 41 with a spring 43 connected between them. This spring can be any of the springs described as suitable for use in the first embodiment and operates in the same manner. In this embodiment the lift cords 8 are collected on a spool 44 carried on a common axle 42 with the take up drum 24. Consequently, the take up drum 24 and the spool 44 will turn together in the same direction. As in the first embodiment there is a lock mechanism (not shown) that is connected to the take up drum or spool 44 through a gear mechanism or other suitable means.

Figure 5:
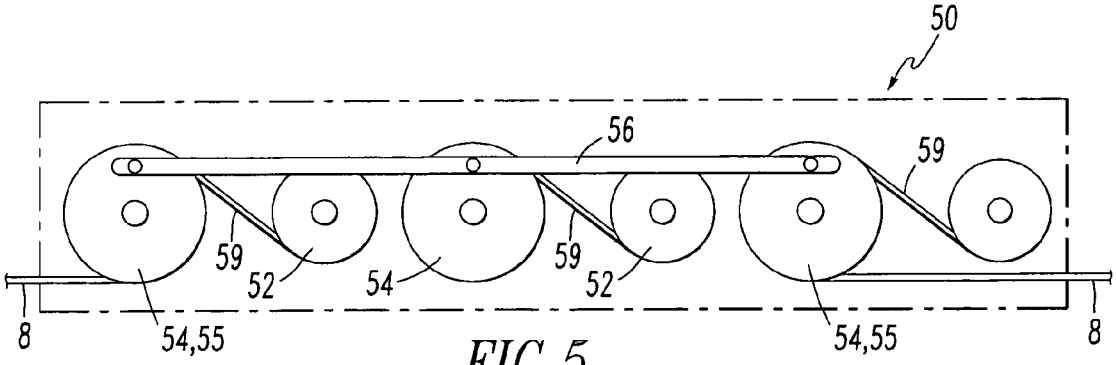
FIG. 5 is a front view of three interconnected spring motors that can be used in the cordless blind of the present invention.

Another spring motor configuration is illustrated in FIG. 5. This spring motor 50 has three take-up drums 52 each carrying a spring that is also connected to an associated storage drum 54. A link 56 connects the take up drums together. The lift cords are wound on spools connected to a respective storage drum. This spool and take up drum configuration is similar to the spool 42 and take up drum 24 shown in FIG. 4. In the embodiment of FIG. 5 the spools are behind the take up drums and thus are not visible in the figure. A spring 59 is connected between each storage drum 54 and take up drum 52 pair. This spring can be any of the springs described as suitable for use in the first embodiment and operates in the same manner. A lock mechanism (not shown) is connected to at least one of the storage drums or spool. The lock mechanism operates in the same manner as the lock mechanism described in the embodiment of FIGS. 1, 2 and 3.

Figure 6:
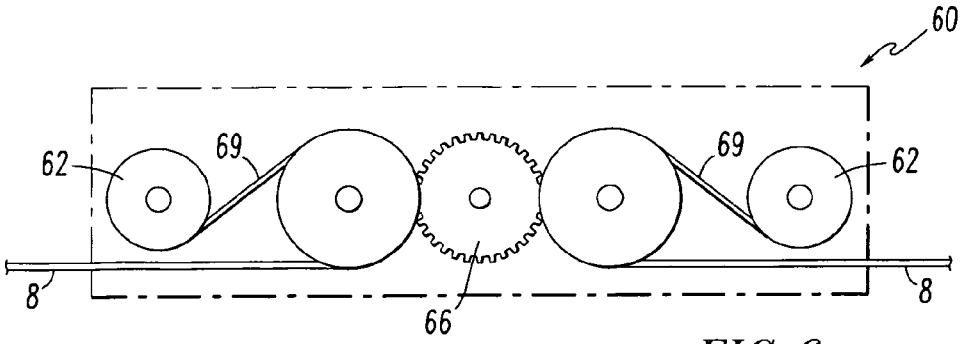
FIG. 6 is a front view of two interconnected spring motors that can be used in the cordless blind of the present invention.

Yet another spring motor configuration is shown in FIG. 6. The spring motor 60 has two take-up drums 62 each carrying a spring 69 that is also connected to an associated storage drum 64. This spring can be any of the springs described as suitable for use in the other embodiments and operates in the same manner. The two storage drums have gear teeth or an associated gear that meshes with gear 66. Thus, the two storage drums will turn simultaneously but in opposite directions. A lock mechanism (not shown) is connected to the gear 66 or to at least one of the storage drums or spool. The lock mechanism operates in the same manner as the lock mechanism described in the embodiment of FIGS. 1, 2 and 3.

Figure 7:
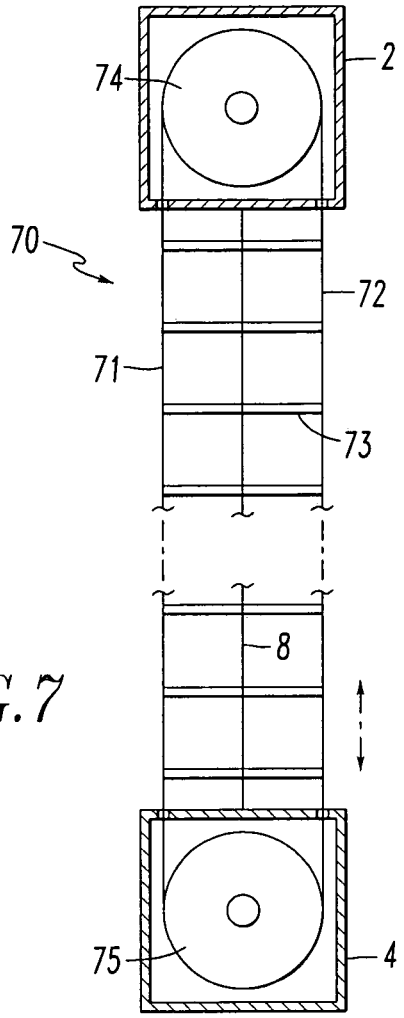
FIG. 7 is an end view of a ladder and associated pulleys that can be used when the cordless blind of the present invention is configured as a venetian blind.

In the event that the cordless blind is a venetian type blind I prefer to configure the ladders as shown in FIG. 7. Those ladders 70 have opposite rails 71, 72 having rungs between them that carry slats 73. The ends of the rails 71, 72 are connected together to form a loop. Pulleys 74 and 75 in the headrail 2 and the bottomrail 4 are positioned at either end of the loop and support the ladder. The slats can be tilted by pulling one of the ladder rails up or down as indicated by the double-headed arrow or a conventional tilt mechanism can be provided in the headrail.

Figure 8:
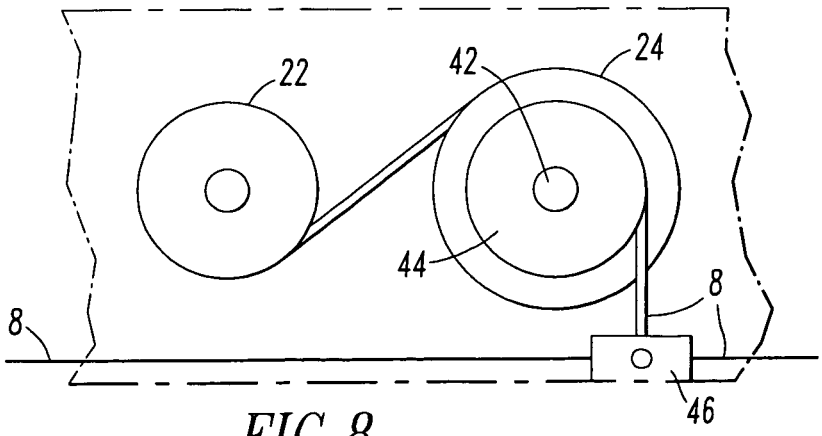
FIG. 8 is a front view of an alternative motor and lock mechanism for a second present preferred embodiment of my cordless blind.
Figure 9:
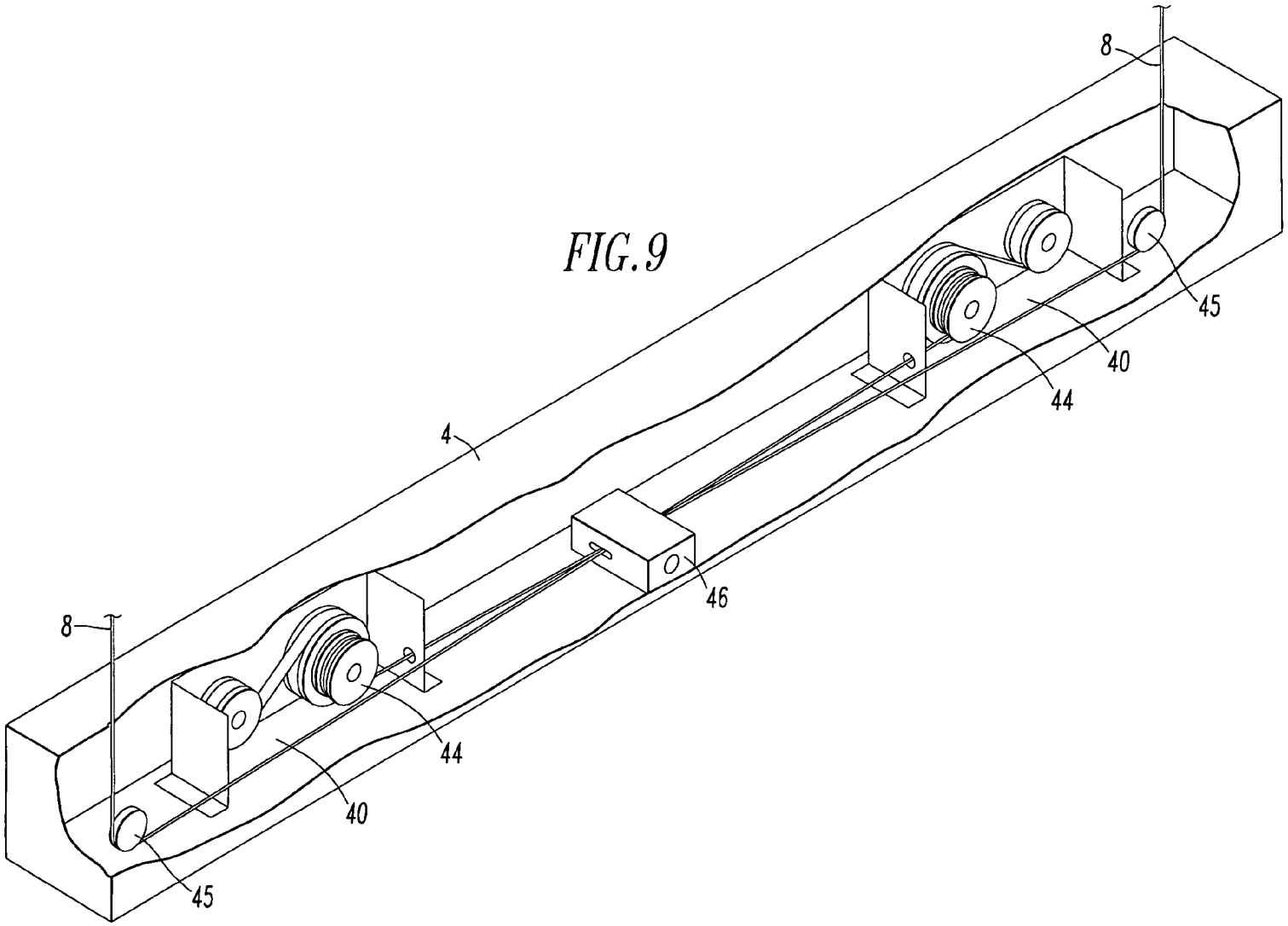
FIG. 9 is a perspective view of a bottomrail partially cut away to show for a third present preferred embodiment of my cordless blind.

Second and third present preferred embodiments of my cordless blind utilize a cord lock in conjunction with one or more spring motors. The spring motor and lock mechanism for the second embodiment shown in FIG. 8 has a single spring motor with a take up drum 24 and storage drum 22. A cord collector spool 44 is carried on the same axle 42 that carries take up drum 24. Consequently, the spring motor will try to wind the lift cords 8 onto the spool 24. The lift cords are routed through a cord lock 46. When the cord lock is in a locked position, the lift cords cannot be wound onto the spool. When the cord lock is unlocked the spring motor will wind the lift cords onto the spool raising the blind. Furthermore, while the cord lock is unlocked a user could pull the bottomrail down overcoming the force of the spring motor and lowering the blind. The cord lock 46 may contain a rotary-cam lock mechanism that acts directly on the cords. The third present preferred embodiment has a bottomrail illustrated in FIG. 9 containing two spring motors 40 similar to the motor shown in FIGS. 4 and 8. The lift cords 8 are routed through the bottomrail, over a pulley 45, through a cord lock 44 to a spool on the spring motor 40. This cord lock may contain a rotary-cam lock mechanism that acts directly on the lift cords 8.

Figure 10:
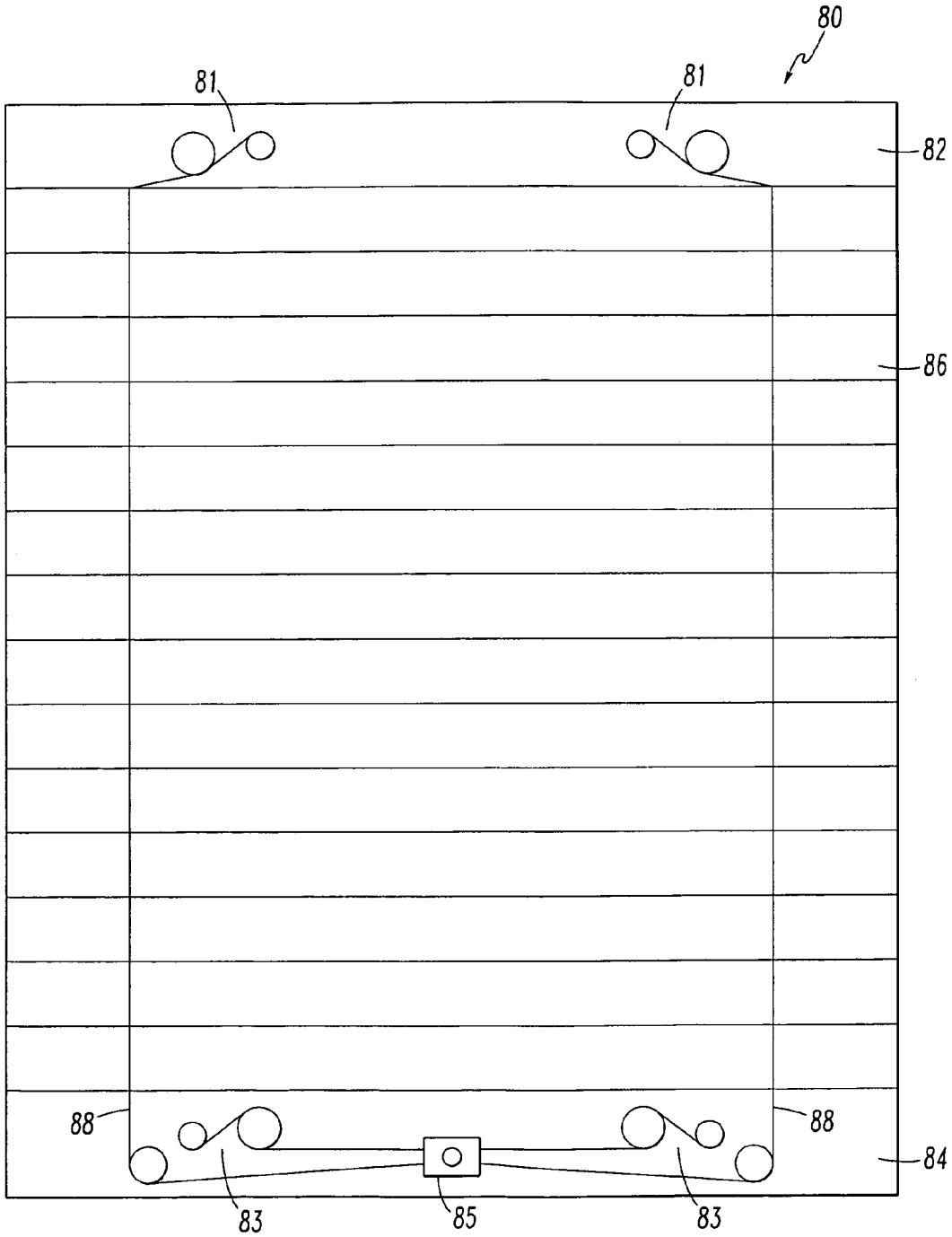
FIG. 10 is a schematic representation of a fourth present preferred embodiment of my cordless blind.

A fourth present preferred embodiment of my cordless blind is illustrated by the schematic of FIG. 10. That blind 80 has a headrail 82, bottomrail 84 and window covering material 86 connected between the headrail and bottomrail. Spring motors 81 and 83 are provided in both the headrail and the bottomrail. The spring motors 81 in the headrail are sized so as to be unable to lift the blind without the help of the spring motors 83 in the bottomrail 84. Lift cords 88 are connected to the spring motors 81 in the headrail as well as the spring motors in the bottomrail 84. The lift cords 88 pass through a cord lock 85 that operates like the cord lock in the embodiments of FIGS. 8 and 9.

It should be noted that in all of the embodiments disclosed thus far the button or other lock activator that operates the lock mechanism extends from the bottomrail. Consequently, no operator cords or wands are needed to operate the blind. The button is easily reached when the blind is partially lowered or in a fully lowered position. However, when the blind is fully raised, an operator may be unable to reach the button without climbing on a ladder or chair. That disadvantage can be overcome by using the lock mechanisms hereinafter described.

Figure 11:
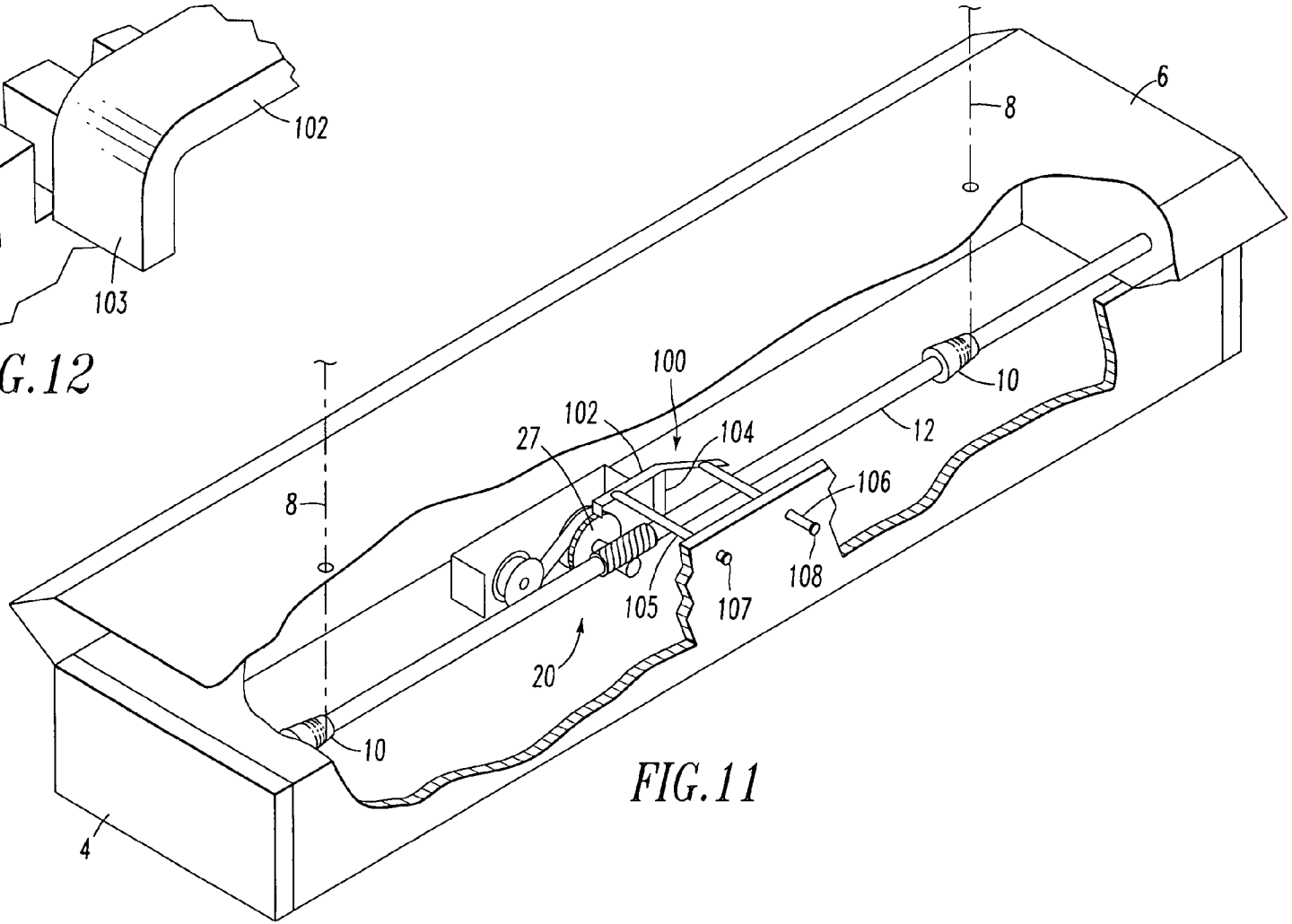
FIG. 11 is a perspective view similar to FIG. 2 showing a second preferred lock mechanism in a cordless blind.
Figure 12:
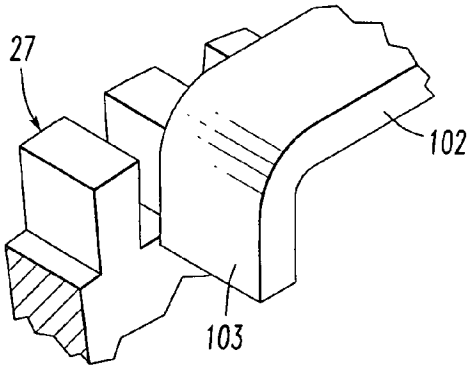
FIG. 12 is a fragmentary view of the end of the locking arm used in the lock mechanism illustrated in FIG. 11.

A second present preferred locking mechanism 100 is shown in FIGS. 11 and 12. This locking mechanism can be used in conjunction with a gear 27 provided in the spring motor 20 as shown in FIG. 11. The lock mechanism can also be used in those blinds having a gear attached a cord spool or a gear connecting several spring motors as illustrated in FIG. 6. In lock mechanism 100 there is a locking arm 102 having a tooth 103 which is sized to fit between gear teeth in gear 27. The locking arm is pivotably mounted in the bottomrail on post 104. Rods 105 and 106 extend from the locking arm 102. A button 107, 108 is provided on each of the rods 105 and 106. Rods 105 and 106 are positioned so that when button 107 is pushed the locking arm will be in engagement with gear 27 preventing the spring motor and the cord collectors 10 on shaft 12 from turning in either direction. When button 108 is pressed the locking arm 102 pivots on post 104 to become disengaged from gear 27. Then, the spring motor 20 and shaft 12 on which cords 8 are collected are free to move in either direction. It should be apparent to those skilled in the art that one could substitute a sprocket or a gear for locking arm 102. A button, lever or knob could be provided to alternately engage or disengage the sprocket from gear 27. This could be done by moving the sprocket into and away from engagement of gear 27. Another option is to provide a sprocket with missing teeth such that turning the sprocket will cause the sprocket to alternately engage and then disengage gear 27.

Figure 13:
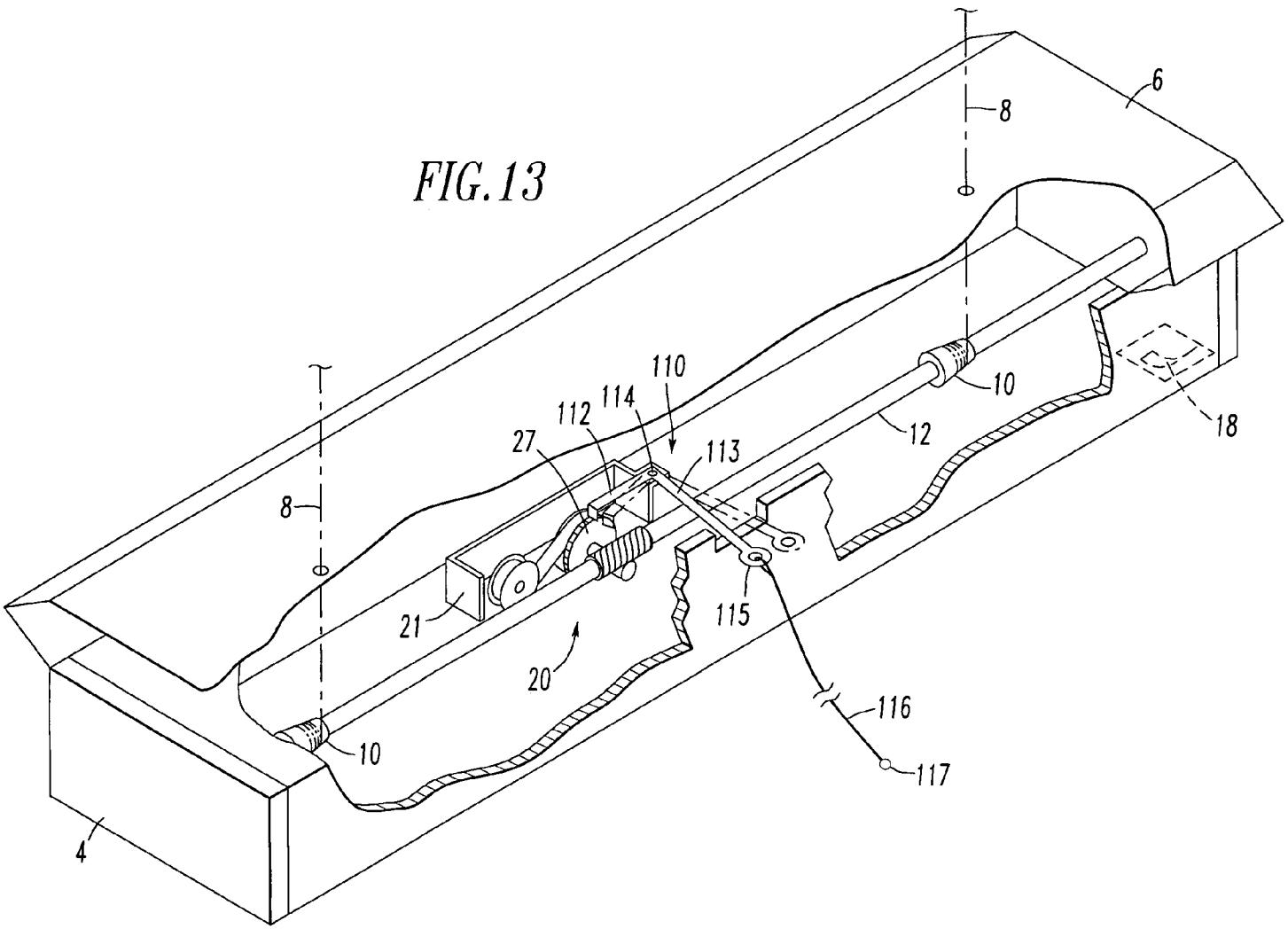
FIG. 13 is a perspective view similar to FIGS. 2 and 11 showing a third present preferred lock mechanism in a cordless blind.
Figure 14:
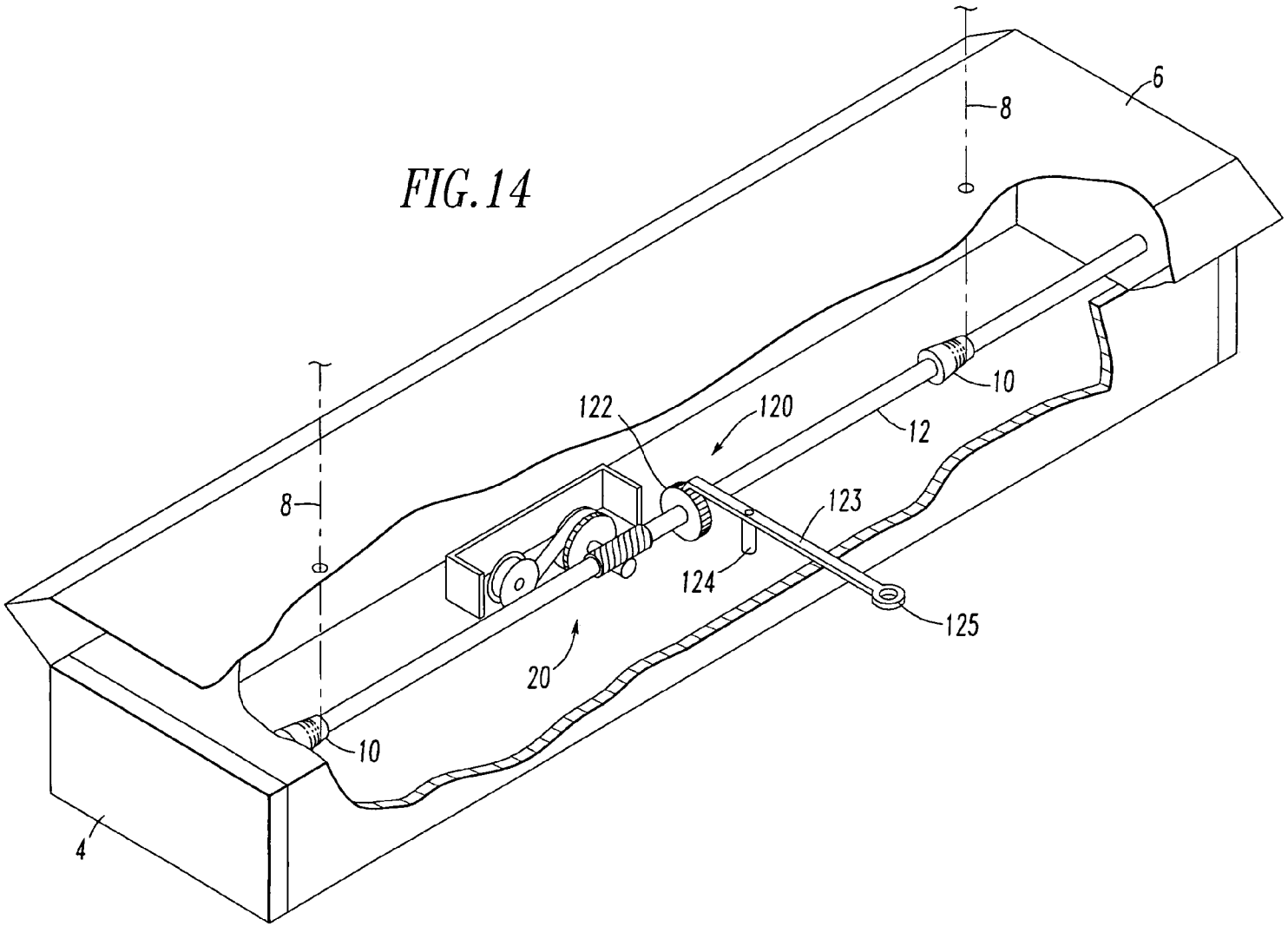
FIG. 14 is a perspective view similar to FIGS. 2, 11 and 13 showing a fourth present preferred lock mechanism in a cordless blind.

A third present preferred lock mechanism 110 shown in FIG. 13 has a locking arm 112 similar to locking arm 102 in the embodiment of FIG. 11. In the lock mechanism 110 a lever 113 is attached to the locking arm. This assembly is attached to the spring motor bracket 21 by pivot pin 114. To disengage the lock mechanism from gear 27 an operator moves the lever and locking arm to the position shown in dotted line in FIG. 13. I prefer to provide an eyelet 115 at the end of the lever to which a cord 116 or wand (not shown) could be attached. A magnet 117 is provided at the end of the opposite cord 116. An operator may choose to attach the free end of the cord to the bottomrail 4 with magnet 117. Alternatively, a clip 118 shown in dotted line can be provided for attaching the cord 116 to the bottomrail when the cord is not in use. One could substitute a wand (not shown) for cord 116. The wand could be secured by a magnet or a clip in the same manner as cord 116. One advantage of this lock mechanism is that it can be operated while the bottomrail is beyond the reach of the operator. When so positioned the operator can use cord 116, or a wand used in place of cord 116, to move the lever 113 from the locked position to the unlocked position. The lock mechanism 120 shown in FIG. 4 has a ratchet 122 provided on shaft 12. This ratchet operates in the same manner as the ratchet system in a roller shade. However, instead of a pawl I provide a lever 123 supported on post 124. The lever 123 is pivotally attached to post 124. Therefore, moving the lever from side to side alternately engages and disengages the lever from ratchet 122. I prefer to provide a eyelet 125 on the end of the lever to receive an operator cord or wand.

Figure 15:
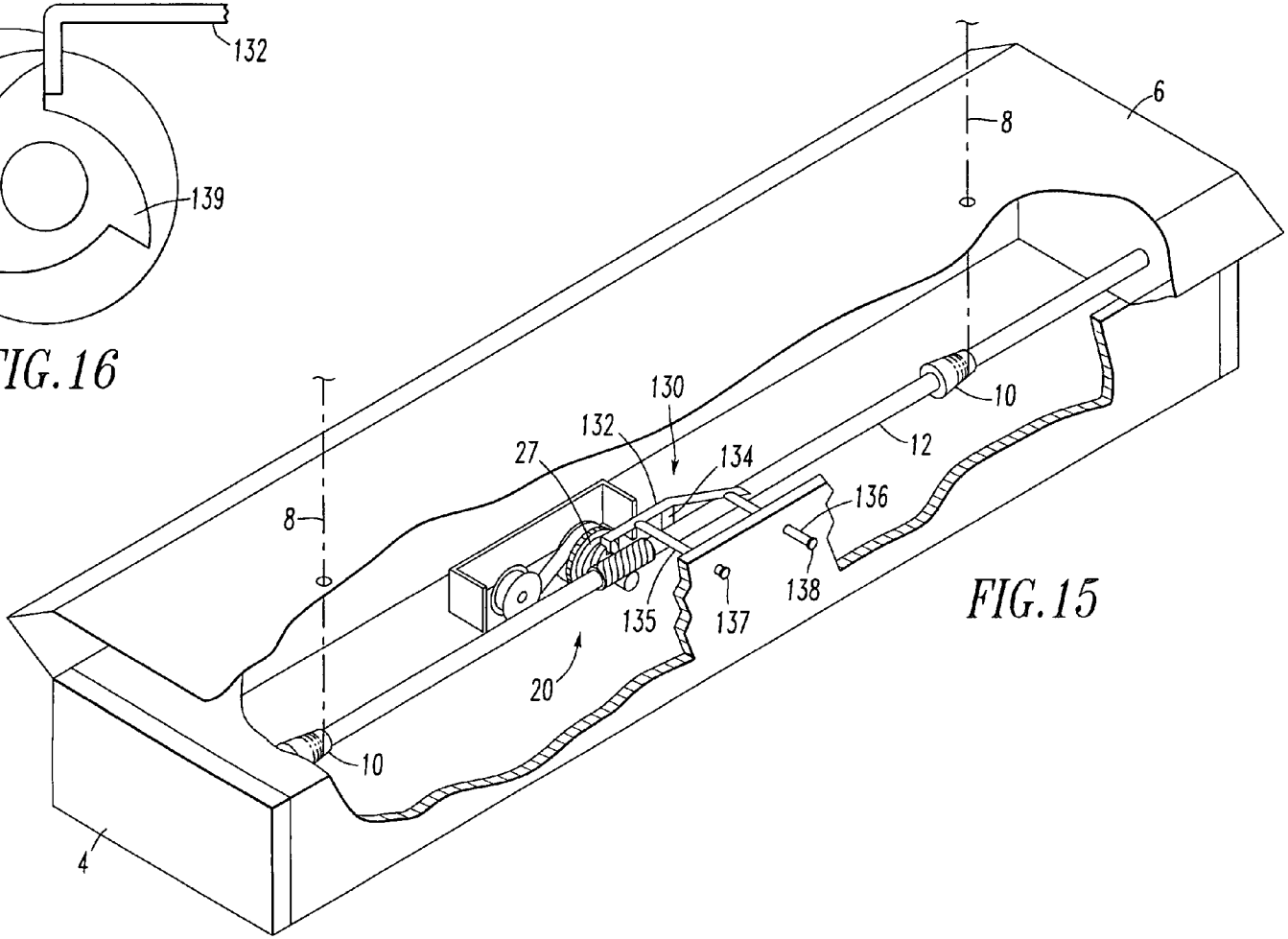
FIG. 15 is a perspective view similar to FIGS. 2, 11, 13 and 14 showing a fifth present preferred lock mechanism in a cordless blind.
Figure 16:
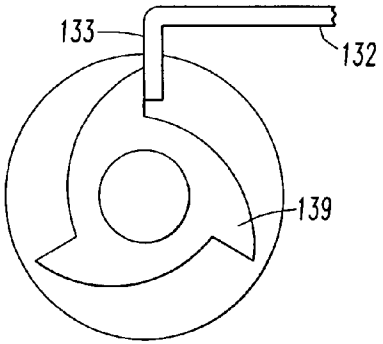
FIG. 16 is a side view of the ratchet and end of the locking arm used in the embodiment of FIG. 15.

The lock mechanism shown in FIGS. 15 and 16 is similar to the lock mechanism of FIG. 11. This lock mechanism 130 has locking arm 132 pivotally mounted on post 134. Rod 135, having button 137, and rod 136, with button 138, are attached to the locking arm 132. In this embodiment a ratchet 139 is attached to the face of gear 27. When the locking arm is in the locked position tooth 133, of the locking arm 132 engages the ratchet 139 as shown in FIG. 16. The ratchet is configured such that when engaged by tooth 113 of locking arm 132, the ratchet can turn in a counterclockwise direction, but is restrained from movement in a clockwise direction. Of course, one could configure ratchet 139 to permit movement in a clockwise direction and restrain movement in a counterclockwise direction. When button 137 is pressed, locking arm 132 will engage ratchet 139 as shown in FIG. 16. Then, the spring motor and cords are free to move in only one direction. Pressing button 138 disengages locking arm 132 from ratchet 139. When the locking arm is disengaged, the spring motor and lift cords are free to move in either direction.

Figure 17:
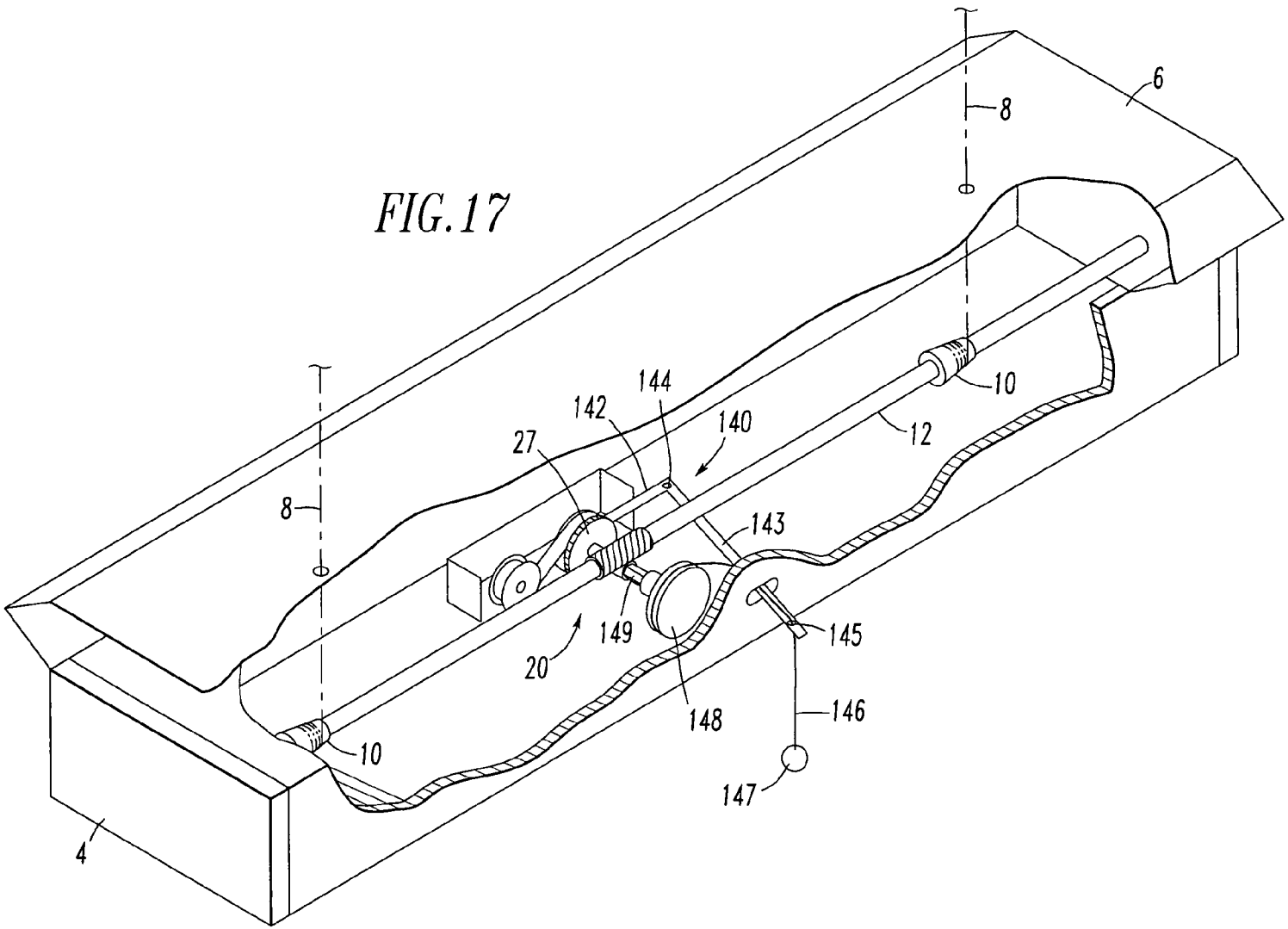
FIG. 17 is a perspective view similar to FIGS. 2, 11, 13, 14 and 15 showing a sixth present preferred lock mechanism in a cordless blind and an operator device.

The lock mechanism 140 shown in FIG. 17 is quite similar to the lock mechanism illustrated in FIG. 13. A locking arm 142 engages gear 27 from under the gear. Lever 143 extends from locking arm 142 from a location near pivot pin 144 which attaches the locking arm 142 to the bottomrail. As in the embodiment shown in FIG. 13, movement of lever 143 to the left or right engages or disengages the locking arm from gear 27. An operator cord 146 extends from spool 148 through a hole 145 at the free end of lever 143. A tassel, or preferably a weight, 147 is provided on the cord.

In the embodiments disclosed in FIGS. 13 through 16, operator devices, such as operator cords or wands, can be used to operate a lock mechanism. One such cord 116 is shown in FIG. 13. However, while these cords provide a functional advantage in permitting an operator to lock or unlock a lock mechanism that is out of reach without climbing on a ladder, stool or chair, the operator device can also be detrimental to the aesthetic appearance of the window covering. That disadvantage can be overcome by using the operator devices described below.

It should be understood that the term, "selected distance," as used herein refers to the distance between the bottomrail and the headrail at which the bottomrail is sufficiently close to the headrail that the lock mechanism in the bottomrail or the bottomrail itself is beyond the user's reach. At this selected distance, it is desirable to have an operator device, such as one comprising a cord or wand, released so that at least a portion of the operator device will fall to within a user's reach and permit the user to activate or control the bottomrail or the lock mechanism in bottomrail without having to use a stool or ladder.

A present preferred operator device is shown in FIG. 17 and acts to unwind the operator cord 146 when the bottomrail is closer than a selected distance from the headrail and winds the operator cord 146 when the bottomrail is below a selected distance from the headrail. A clutch or motor 149 is attached to the spool and is also connected to either the motor 20 or shaft 12. The clutch or motor 149 acts to rotate spool 148 such that operator cord 146 is wound when the bottomrail moves below a selected distance from the headrail. When the bottomrail moves above a selected distance from the headrail, the clutch or motor 149 releases the spool, allowing the spool to turn freely. Weight 147 will draw operator cord 146 from the spool, unwinding the operator cord. The diameter of the weight 147 is larger than the diameter of the hole 145 through which cord 146 passes so that the cord and weight cannot be fully retracted into the bottomrail.

Figure 18:
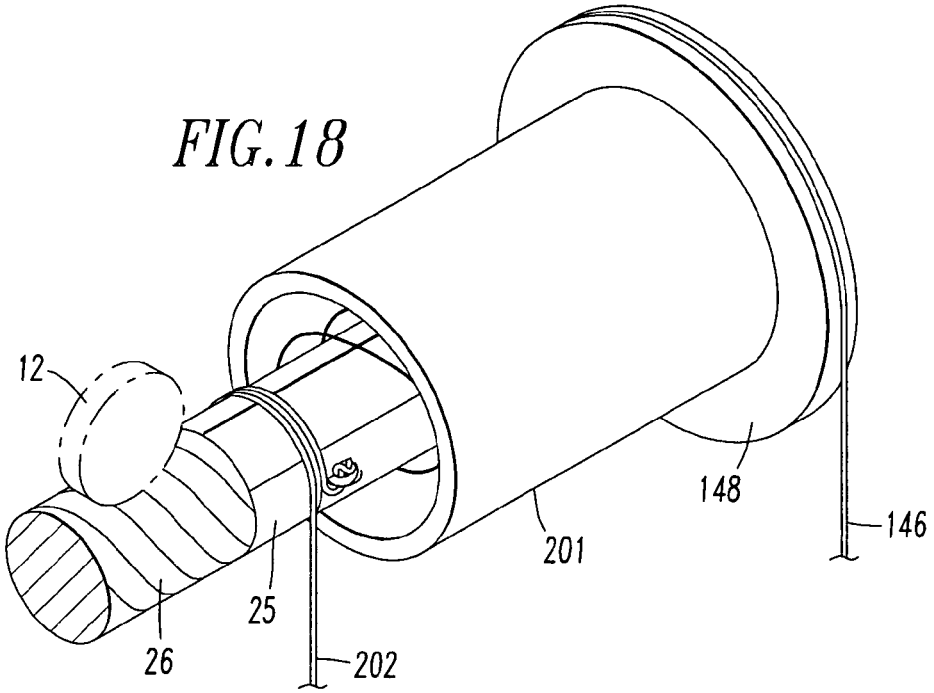
FIG. 18 is an enlarged view of a first present preferred embodiment of the operator device shown in FIG. 17.
Figure 19:
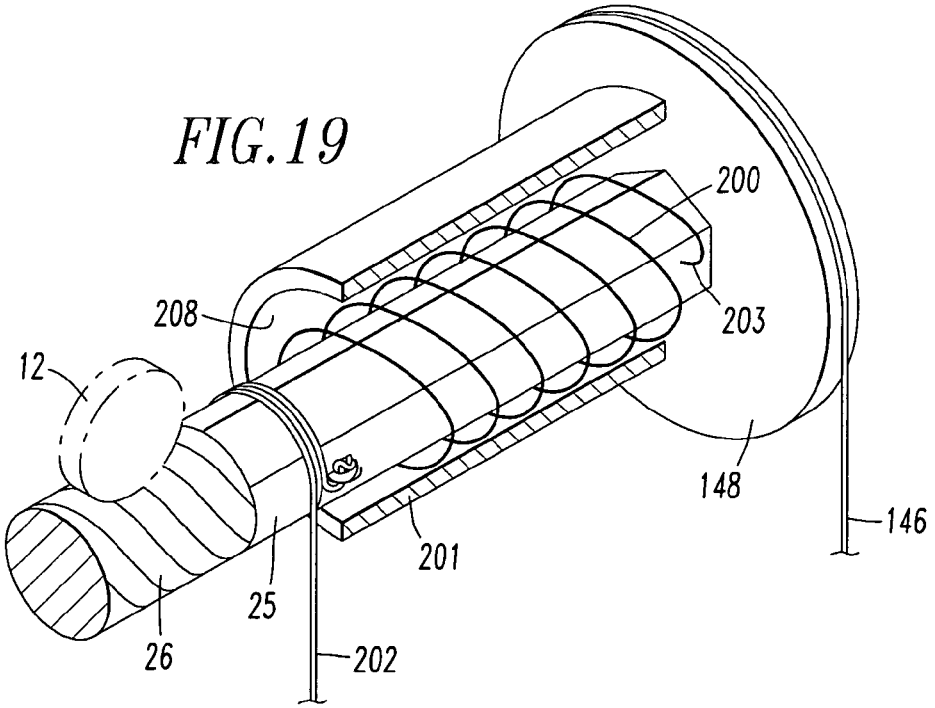
FIG. 19 is a perspective view of the operator device shown in FIG. 18 wherein a portion of the cover of the operator device has been cut away.

A first present preferred embodiment of an operator device is illustrated in FIGS. 18 and 19. Shaft 25, which serves as an axle and operates as discussed above, has gear 26 that is rotated by shaft 12. Helical gears can be used here. Spring 200 is coiled around the end of shaft 25 that is within cover 201, as shown in FIG. 19. One end of the spring 202 is fixed to the bottomrail or a mounting on the bottomrail (not shown) and does not move. The opposite end of the spring 203 is attached to shaft 25 such that rotation of shaft 25 causes attached spring 200 to contract or expand in coil diameter. Spool 148 is attached to cover 201. As the bottomrail moves downward, shaft 25 rotates in one direction and causes spring 200 to expand. When the bottomrail has been moved to a position below a selected distance from the headrail, spring 200 comes in contact with the inner wall 208 of cover 201. Friction between spring 200 and cover 201 causes cover 201 and spool 148 to rotate, which winds the operator cord 146 onto the spool until the cord 146 is retracted to the point that weight or tassel 147 rests against hole 145.

When the bottomrail moves upward, shaft 25 rotates in the opposite direction, which causes spring 200 to contract. When the bottomrail rises to a position above a selected distance below the headrail, spring 200 has contracted to the point that it is no longer in contact with the inner wall 208 of cover 201. Thus, cover 201 and spool 148 are free to rotate in any direction when the bottomrail moves above this selected distance. Gravity acting on weight or tassel 147 then causes spool 148 to rotate such that operator cord 146 is unwound.

I prefer to use a knot or other object on the operator cord that is too large to pass through the hole 145 to prevent any remaining cord to fall out of the bottomrail. Such a knot or other object would come to rest against the perimeter of a hole in the bottomrail through which the cord passes or the perimeter of hole 145 to prevent further passage of the operator cord.

Figure 20:
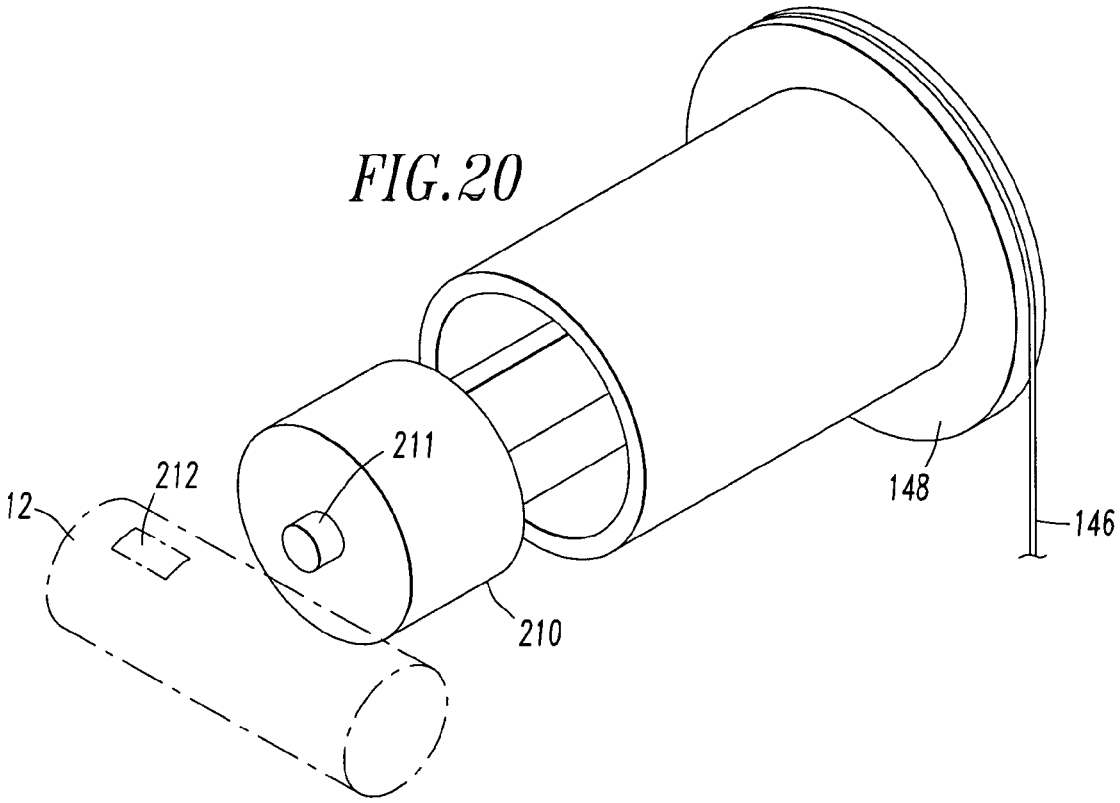
FIG. 20 is a perspective view of a second present preferred embodiment of the operator device shown in FIG. 17.

A second present preferred embodiment of an operator device is shown in FIG. 20. A motor 210 powered by batteries, solar cells, or some other power source is connected to and controls the movement of spool 148. Motor 210 has a sensor 211 which monitors rotation of shaft 12. This can be done by counting the number of time indicator 212 on shaft 12 passes and the direction in which it has moved. Sensor 211 detects the number of rotations made by the shaft 12 and the direction in which the shaft rotated. Those rotations correspond to the distance that the bottomrail has moved toward or away from the headrail. The motor will turn on to unwind cord 146 on spool 148 when the bottomrail is less than a selected distance from the headrail. When the bottomrail is more than the selected distance from the headrail, the motor is turned on and turns in an opposite direction to wind cord 146 onto spool 148.

It should be understood that the motor may be programmed to wind the cord at different rates depending upon the distance the bottomrail may be from the selected distance. It should also be understood that the motor could be programmed to unwind the cord at the selected distance, but not wind the cord until the bottomrail has traveled some distance below the selected distance.

Figure 21:
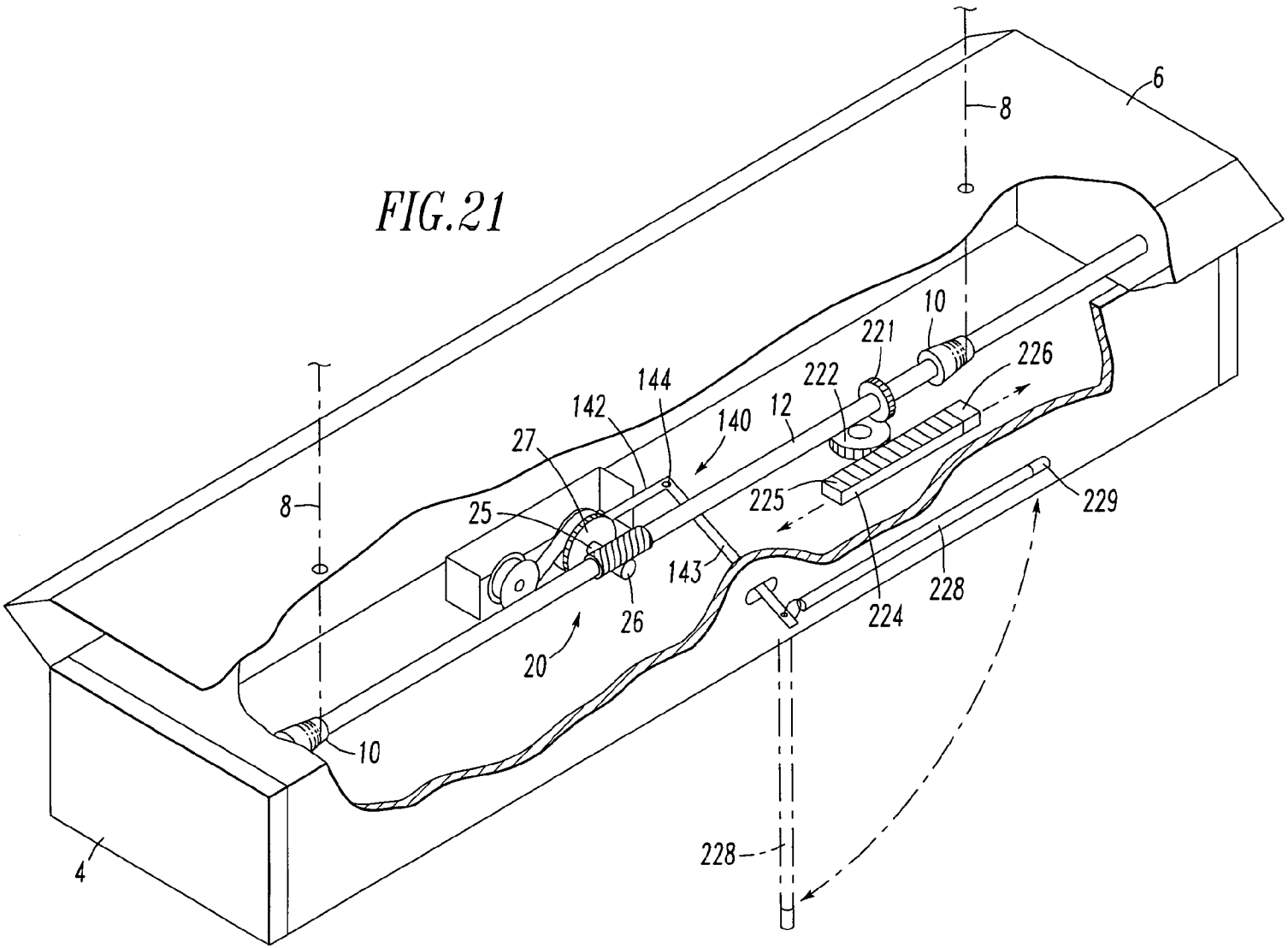
FIG. 21 is a perspective view of a bottomrail similar to FIG. 17 showing a third present preferred operator device.

A third present preferred embodiment of an operator device involves the use of a rack and pinion, as shown in FIG. 21. Gear 221 is attached to shaft 12 such that gear 221 rotates when shaft 12 rotates. Gear 221 meshes with pinion 222 and rotates the pinion. Pinion 222 engages rack teeth 225 that are on rack 224 such that the direction rack 224 moves is dependent upon the direction pinion 222 rotates. Magnet 226, which generates a magnetic field, is attached to rack 224 and slides towards the center portion of the bottomrail or away from the center portion of the bottomrail. Wand 228 is pivotably attached at one end to lever 143 and has a magnet 229 or metal end that is attracted by a magnetic field at or near the opposite end. When the magnetic field of magnet 226 and the magnetic field of magnet 229 sufficiently overlap magnetic force holds the wand against the bottomrail.

As the bottomrail moves upward, the rack 224 and the magnet 229 move toward the center portion of the bottomrail. At some point the magnetic fields of magnets 226 and 229 or magnet 226 and the metal end will be sufficiently far apart that the free end of the wand will fall. This should occur when the bottomrail has risen to a selected distance away from the headrail where an operator may have trouble reaching the bottomrail. The operator may then use the wand to activate a locking mechanism or cord lock and permit the blind to travel further upward or downward. However, the wand does not need to operate the lock, since the spring tension that lifted the blind will also be able to hold the blind up. In a counterbalanced shade having no lock mechanism the operator is used to simply pull or push the bottomrail. When the operator pulls the blind down to a position where the bottomrail is easily within reach, magnet 226 will have moved away from the center of the bottomrail to a point at which the user may then reattach the wand to the bottomrail. The body of the wand should be made of plastic or a metal, such as aluminum, which is not affected by a magnetic field.

Figure 22:
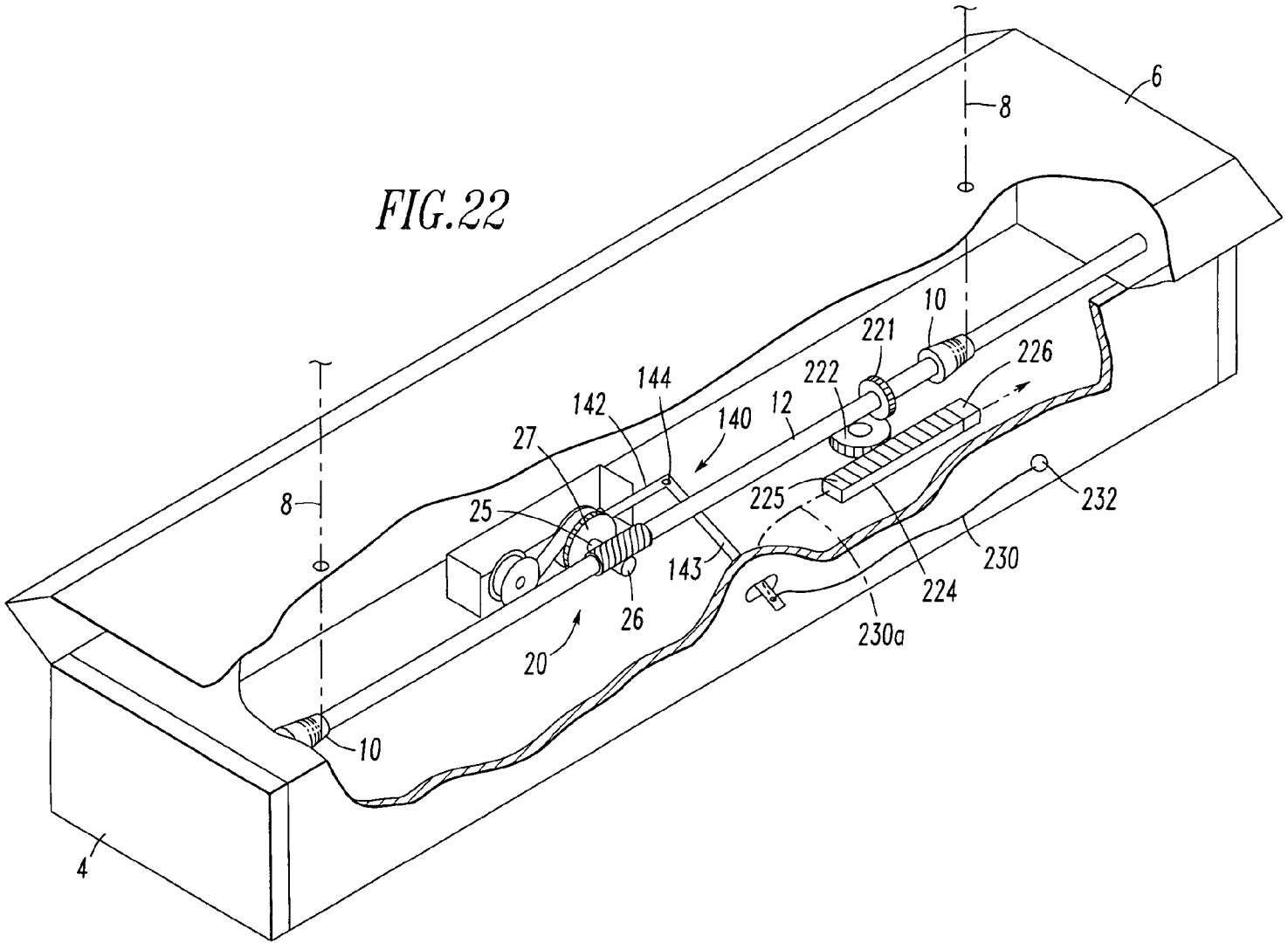
FIG. 22 is a perspective view similar to FIGS. 17 and 21 showing a fourth present preferred operator device.

Alternatively, a cord 230 with a magnetic tassel or metal end 232, as shown in FIG. 22, can be substituted for the wand 228. Yet, another alternative is to connect the cord directly to the rack as indicated by dotted line 230*a*. If that is done the magnets are not needed because movement of the rack will release the cord 230 from the bottomrail and retract the cord at the appropriate position of the bottomrail.

While the rack is illustrated as moving in a longitudinal direction relative to the bottomrail, it is possible that the rack could be positioned to move in a transverse direction or in a direction between the transverse and the longitudinal directions. It should be understood that a magnet could be mounted on a disk or gear that rotates with movement of the shaft 12. Such positioning and rotation would move the magnet 226 toward or away from the location of magnet 229 on wand 228 eliminating the need for a rack.

Magnet or metal end portion 229 can be attached to the wand 228 such that the magnet or metal end portion is slidable along at least a portion of the wand 228. A user could then position the magnet or metal end portion at any selected place on the wand. In this way, the height at which the wand is released may be customized by the user to meet a user's particular needs.

Figure 23:
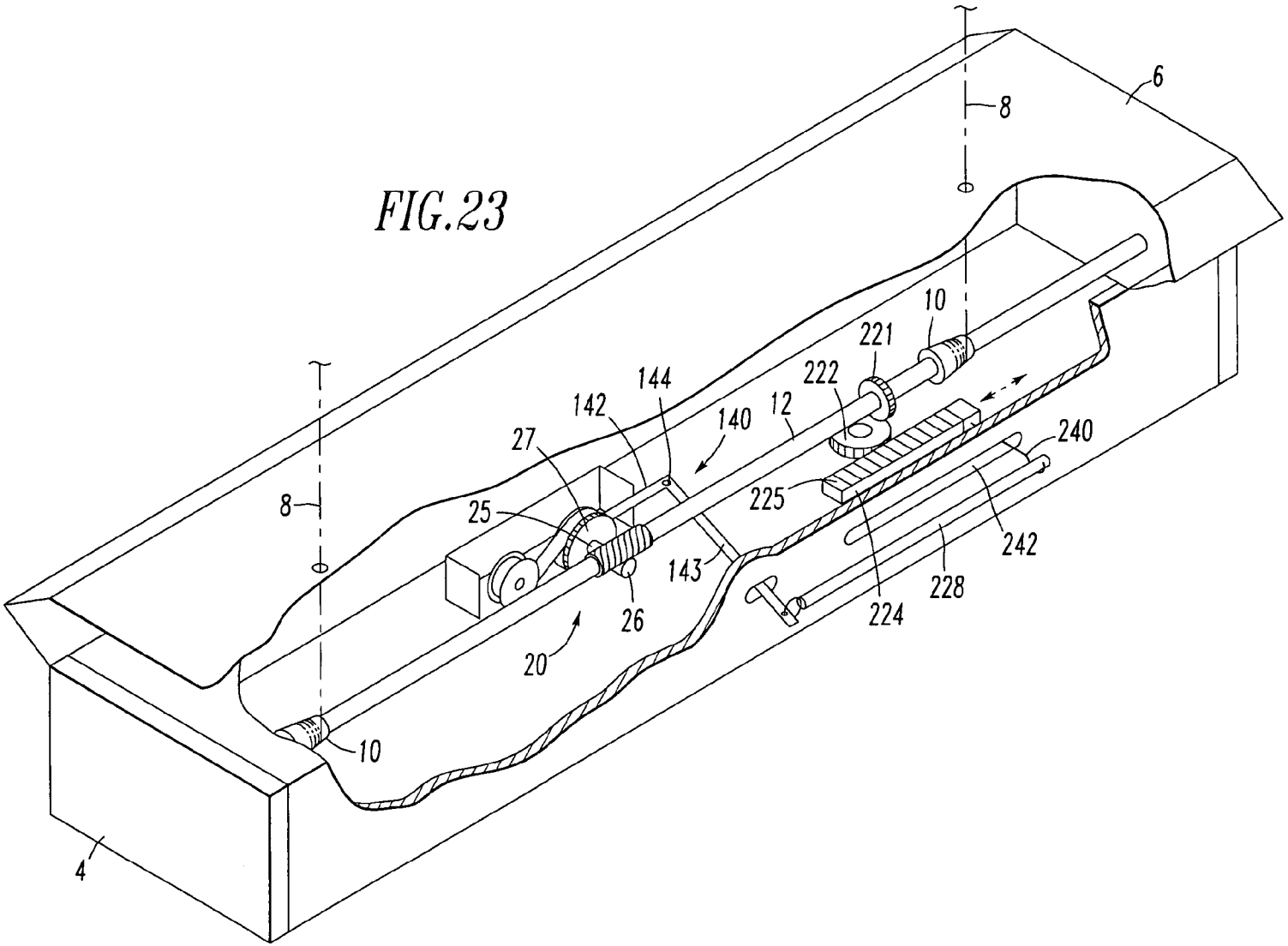
FIG. 23 is a perspective view similar to FIGS. 17, 21 and 22 showing a fifth present preferred operator device.

A fifth present preferred embodiment of an operator device involves the use of a rack and pinion to slide a clip 240 holding a wand 228 to release the wand at a selected distance, as shown in FIG. 23. The rack 224 and pinion 222 would move as in the embodiments shown in FIGS. 21 and 22. The clip 240 is attached to one end or the bottom of the rack 224. The clip 240 extends below the bottomrail through a slot 242 in the bottom of the bottomrail. Clip 240 holds the wand 228 near the bottomrail until the rack moves the clip beyond the free end of the wand. When the bottomrail rises to a selected distance away from the headrail, the clip is slid away from the end of the wand such that wand 228 is released from the clip 240. An operator may then use the wand to activate the locking mechanism or cord lock and permit the blind to travel downward. The user may then reattach the wand to the clip when the bottomrail is in a convenient, sufficiently lowered position. The clip will then hold the wand until the bottomrail is raised to the selected distance below the headrail.

I prefer to use a J-hook for the clip, which permits users to more easily reattach the wand to the clip. An eye-hook could also be used. It should be understood that the clip can be slid in any direction or may even tilt to hold or release the wand. Additionally, a ramp may be provided in the bottomrail over which the rack or a portion of the hook travels so that the hook can be pulled into the bottomrail at selected locations.

Figure 24:
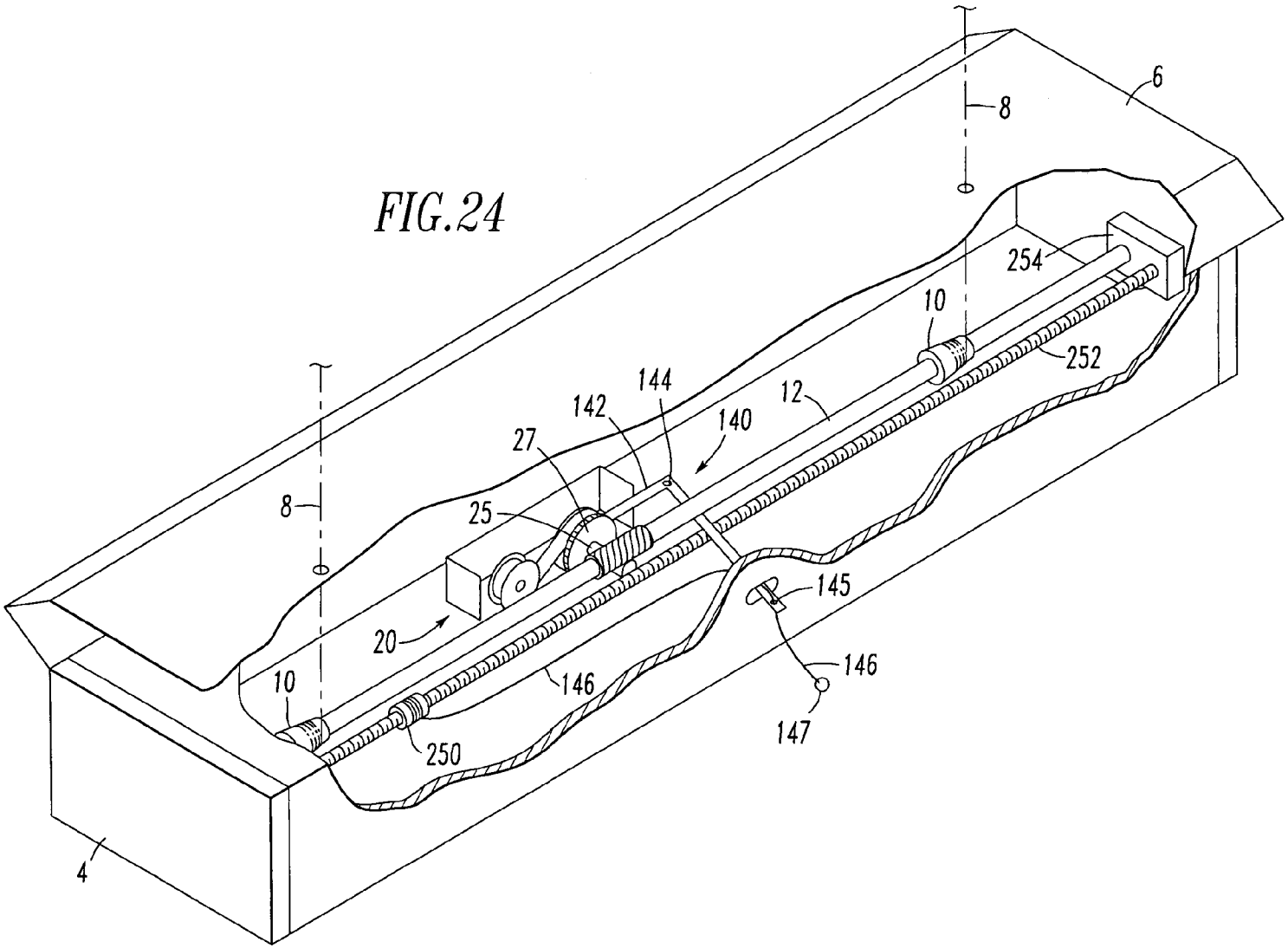
FIG. 24 is a perspective view similar to FIGS. 17, 21, 22 and 23 showing a sixth present preferred operator device.

A sixth present preferred embodiment of an operator device involves the use of a traveler along a path, as shown in FIG. 24. Traveler 250 travels along a path defined by threaded shaft 252. Shaft 252 is driven by shaft 12 through a gearbox 254. When the bottomrail is fully lowered, traveler 250 is located at a far end of the bottomrail and has cord 146 wound around it and within the bottomrail such that only tassel or weight 147 is located outside the bottomrail. As the bottomrail rises, the traveler moves toward the center of the bottomrail along shaft 252 such that cord 146 is unwound and released from the bottomrail. When the bottomrail is lowered, the traveler moves in the opposite direction and winds the cord into the bottomrail.

It should be understood that a spring clutch, similar to the one shown in FIGS. 18 and 19 and described above, can be attached to the traveler and the bottomrail such that, as the traveler travels in one direction along shaft 252, the spring 200 expands such that it comes into frictional contact with inner wall 238 of cover 201. This frictional contact acts to wind the spool 148 attached to the cover 201 such that cord 146 is wound onto the spool. When the traveler moves in the opposite direction, spring 200 contracts such that, when the bottomrail rises to a selected distance from the headrail, the spring disengages from the cover, permitting the cover and spool to turn freely acting on a weight or tassel 147. Gravity then causes spool 148 to rotate such that operator cord 146 is unwound.

Figure 25:
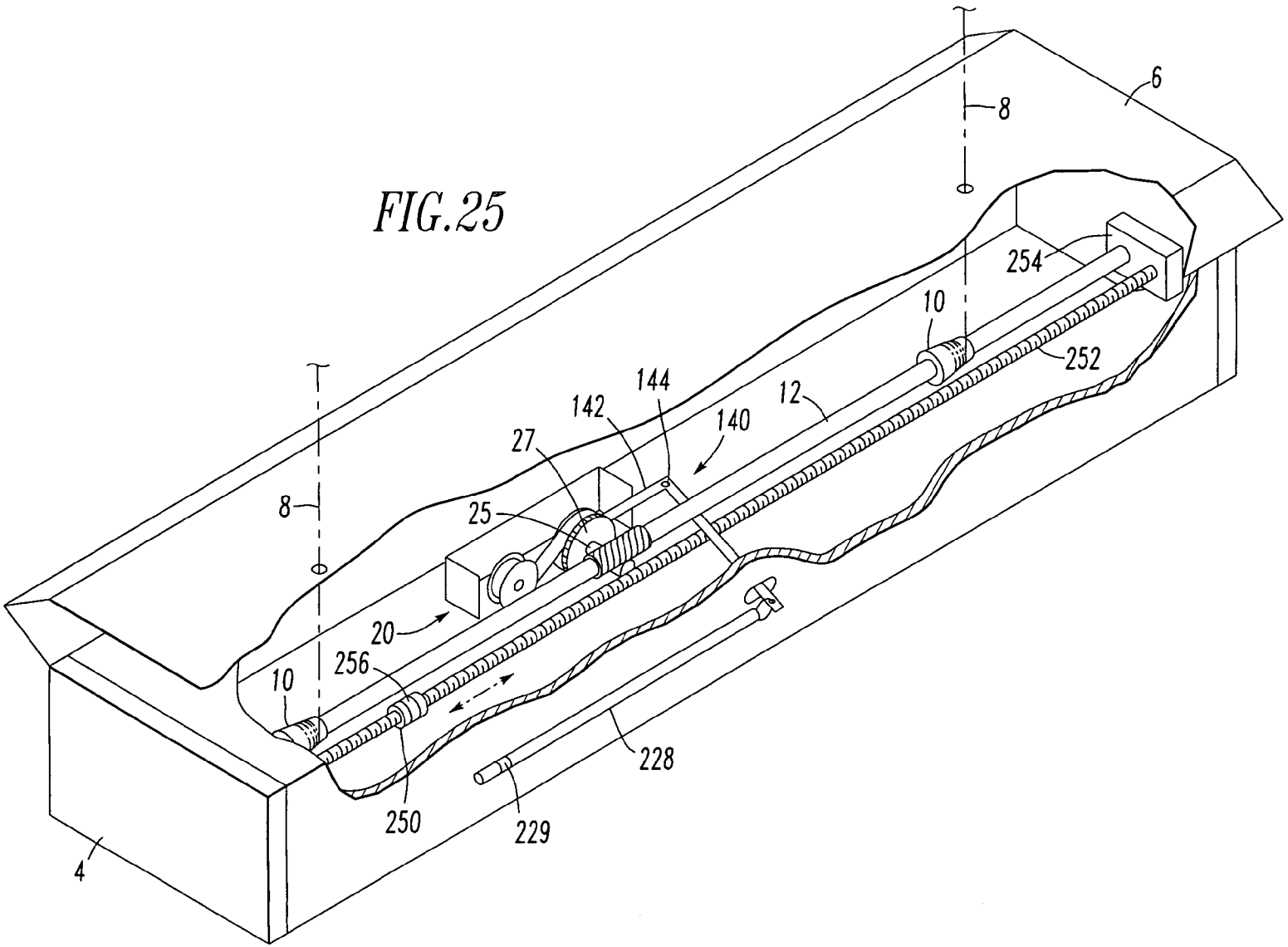
FIG. 25 is a perspective view similar to FIGS. 17, 21, 22, 23 and 24, showing a seventh present preferred operator device.

A seventh present preferred embodiment of my operator device involves the use of a traveler 250 and a magnet 256, as shown in FIG. 25. Operating similar to the embodiment shown in FIG. 21, the traveler moves magnet 256 toward or away from the magnet or metal end 229 on wand 228 to hold or release the wand. It should be understood that a fully magnetic cord, a fully magnetic wand, or a cord with a magnetic end or metal end could be substituted for the wand with the magnet or metal end.

Figure 26:
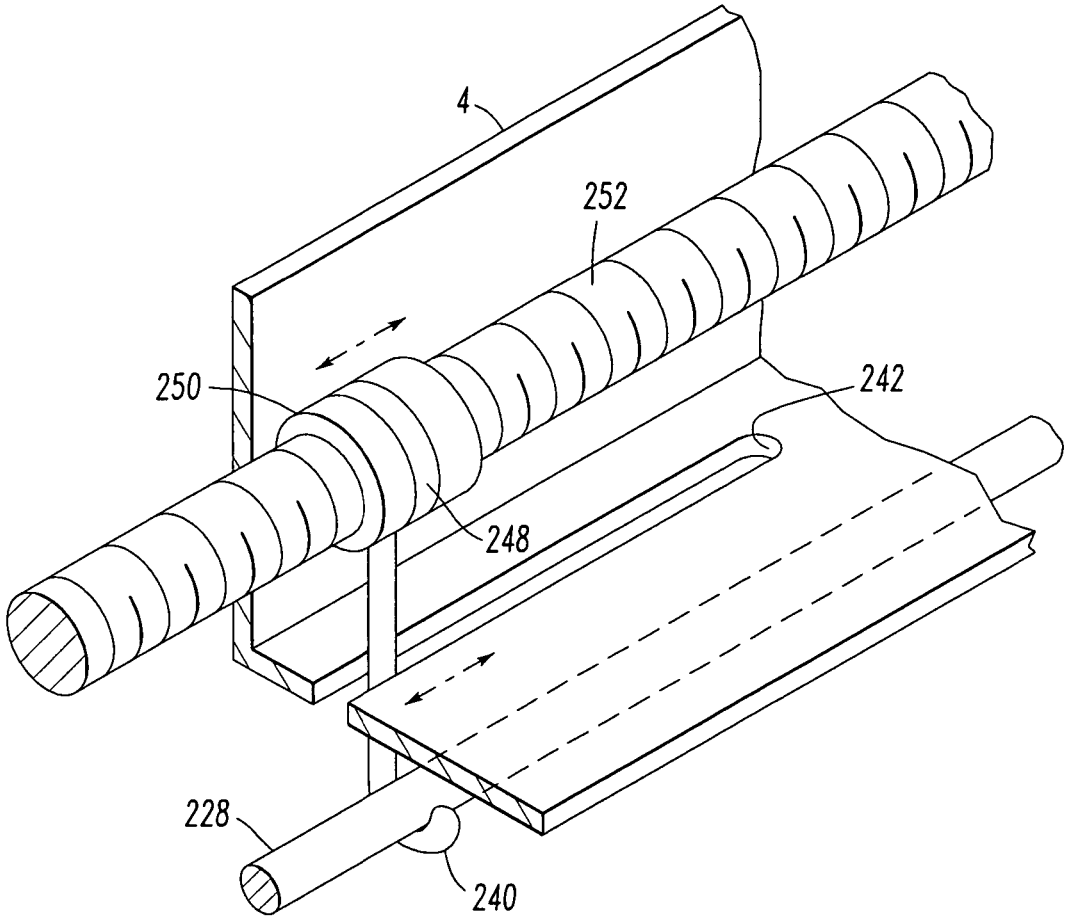
FIG. 26 is a fragmentary view illustrating a portion of an eighth present preferred operator device.

An eighth preferred embodiment is shown in FIG. 26. A clip 240, instead of a magnet or cord is attached to the traveler by a ring 248 connected to the traveler such that the clip stays in a substantially constant position relative to the traveler while the traveler rotates along shaft 252. Similarly to the fifth present preferred operator device shown in FIGS. 23 and 24, the clip hangs through a slot 242 in the bottom of the bottomrail 4 and holds a wand 228. As the bottomrail rises, the traveler moves the clip 240 along the wand such that the clip 240 releases the wand 228 when the bottomrail rises to a selected distance from the headrail. As in the preferred embodiment shown in FIG. 23, a user may reattach the wand to the clip after lowering the blind.

The traveler 250 and shaft 252 are the same in FIGS. 24, 25 and 26. In FIG. 26 one can see a slot 242 below the shaft which together with hook 240 that passes through the slot limits the travel of the traveler along the shaft and prevents the traveler 250 from rotating on the shaft 242. Those skilled in the art will recognize that traveler 250 shown in FIGS. 24 and 25 may have a similar hook or projection that fits into a slot which are not seen in these figures because they are under the traveler and shaft.

It should also be understood that, in addition to permitting an operator to control lock mechanisms, such as the ones discussed above, operator devices of the type disclosed above can also be used to control a tilter or other mechanisms that may be provided in a headrail or bottomrail that are out of an operator's reach.

The embodiments illustrated in the drawings are top stacking blinds having a fixed headrail and movable bottomrail. However, the invention is not limited thereto. The blind could be a bottom stacking blind in which the top rail moves and the bottomrail is fixed. The blind could also be a top-down, bottom-up blind having a headrail, a bottomrail and a moving rail. The lock mechanism could be located in the moving rail or the bottomrail. In all these shades there is a first rail and a second rail with the lock mechanism being located in a rail that moves.

Although I have shown certain present preferred embodiments of my cordless blind it should be distinctly understood that the invention is not limited thereto, but may be variously embodied within the scope of the following claims.

The invention claimed is:

1. An improved cordless blind of the type comprising a headrail, a bottomrail, window covering material connected between the headrail and the bottomrail, and a cordless lift mechanism having at least one spring motor for moving the bottomrail relative to the headrail, the improvement comprising:

an operator device connected to the lift mechanism and moveable relative to the bottomrail such that when the headrail and the bottomrail are a selected distance from one another, movement of the bottomrail toward the headrail will cause a portion of the operator device will move away from the bottomrail.

2. The improved cordless blind of claim 1, wherein the operator device is comprised of a wand.

3. The improved cordless blind of claim 2, wherein the wand is metal or plastic.

4. The improved cordless blind of claim 2, wherein the wand has a magnetic end.

5. The improved cordless blind of claim 4, wherein the magnetic end is held by a magnet that is connected to the lift mechanism, the magnet being moveable through the bottomrail and configured to hold the magnetic end when the bottomrail is more than a selected distance from the headrail and release the wand when the bottomrail is less than the selected distance from the headrail.

6. The improved cordless blind of claim 1, wherein the operator device is comprised of a cord that is wound on a spool and a clutch connected to the spool, wherein the clutch unwinds the cord from the spool when the bottomrail is less than the selected distance from the headrail and winds the cord on the spool when the bottomrail is more than the selected distance from the headrail.

7. The improved cordless blind of claim 1, wherein the operator device is comprised of a wand that is held by a clip connected to the lift mechanism, the clip being moveable through the bottomrail and configured to hold the wand when the bottomrail is more than the selected distance from the headrail and to release the wand when the bottomrail is less than the selected distance from the headrail.

8. The improved cordless blind of claim 1, wherein the operator device is comprised of a rack and pinion in the bottomrail and one of a cord or wand is releasably attached to the rack.

9. The improved cordless blind of claim 8, wherein the wand is attached to the rack by a clip when the bottomrail is more than the selected distance from the headrail and wherein the rack moves the clip to release the wand when the headrail and the bottomrail are separated by less than the selected distance.

10. The improved cordless blind of claim 8, wherein the wand has a magnetic end that is held by a magnet attached to the rack when the bottomrail is more than the selected distance from the headrail and wherein the rack moves the magnet to release the wand when the headrail and the bottomrail are separated by less than the selected distance.

11. The improved cordless blind of claim 1, wherein the operator device is comprised of a traveler which moves along a path through the bottomrail, and a wand adjacent to the bottomrail.

12. The improved cordless blind of claim 11, wherein the wand is held by a clip attached to the traveler when the bottomrail is more than the selected distance from the headrail and the traveler moves along a path defined by a threaded shaft to cause the clip to release the wand when the headrail and the bottomrail are separated by the selected distance.

13. The improved cordless blind of claim 11, wherein the wand has a magnetic end.

14. A cordless blind comprising:

a. a first rail;

b. a second rail;

c. a window covering material connected between the first rail and the second rail;

d. a plurality of lift cords each attached to the first rail and passing into the second rail;

e. at least one cord collector about which at least one of the lift cords is wound;

f. a spring motor connected to the at least one cord collector; and g. a lock mechanism connected to at least one of the cord collector, the spring motor and the plurality of lift cords, the lock mechanism having a locked position, wherein at least one of the plurality of lift cords are restrained from at least one of being collected on the cord collector and being removed from the cord collector, and an unlocked position that allows the cord collector and plurality of lift cords to move freely, the lock mechanism having a lock activator which, when acted upon by a force will change the lock mechanism from the locked position to the unlocked position and when acted upon by a force again will change the lock mechanism from the unlocked position to the locked position, the lock mechanism remaining in the locked position or unlocked position after the force is removed; and h. an operator device connected to the lock mechanism, the operator device being moveable relative to the second rail such that when the first rail and the second rail are a selected distance from one another movement of one of the first rail and the second rail toward the other of the first rail and second rail will cause a portion of the operator device will move away from the second rail.

15. The cordless blind of claim 14, wherein the operator device is comprised of a cord that is wound on a spool and a clutch connected to the spool, wherein the clutch unwinds the cord from the spool when the second rail is less than the selected distance from the first rail and winds the cord on the spool when the second rail is more than the selected distance from the first rail.

16. The cordless blind of claim 14, wherein the operator device is comprised of a cord that is wound on a spool and a motor connected to the spool, wherein the motor unwinds the cord from the spool when the second rail is less than the selected distance from the first rail and winds the cord on the spool when the second rail is more than the selected distance from the first rail.

17. The cordless blind of claim 14, wherein the operator device is comprised of a rack and pinion in the second rail and one of a cord or wand attached to the rack.

18. The cordless blind of claim 17, wherein the wand has a magnetic end that is held by a magnet attached to the rack when the second rail is more than the selected distance from the first rail and wherein the rack moves the magnet to release the wand when the first rail and the second rail are separated by less than the selected distance.

19. The cordless blind of claim 14, wherein the operator device is comprised of a magnet which moves along a path through the second rail and a wand adjacent to the bottomrail.

20. The cordless blind of claim 19, wherein the wand has a magnetic end.

* * * * *